US009978381B2

(12) United States Patent
Chebiyyam et al.

(10) Patent No.: US 9,978,381 B2
(45) Date of Patent: May 22, 2018

(54) ENCODING OF MULTIPLE AUDIO SIGNALS

(71) Applicant: QUALCOMM Incorporated, San Diego, CA (US)

(72) Inventors: Venkata Subrahmanyam Chandra Sekhar Chebiyyam, San Diego, CA (US); Venkatraman Atti, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days. days.

(21) Appl. No.: 15/422,988

(22) Filed: Feb. 2, 2017

(65) Prior Publication Data

US 2017/0236521 A1 Aug. 17, 2017

Related U.S. Application Data

(60) Provisional application No. 62/294,946, filed on Feb. 12, 2016.

(51) Int. Cl.

| | |
|---|---|
| ***G10L 19/008*** | (2013.01) |
| ***G10L 19/02*** | (2013.01) |
| ***G10L 19/16*** | (2013.01) |
| ***G10L 19/20*** | (2013.01) |

(52) U.S. Cl.

CPC ..... *G10L 19/008* (2013.01); *G10L 19/0212* (2013.01); *G10L 19/167* (2013.01); *G10L 19/0208* (2013.01); *G10L 19/20* (2013.01)

(58) Field of Classification Search

CPC . G10L 19/008; G10L 19/0212; G10L 19/167; G10L 19/0208; G10L 19/20

See application file for complete search history.

(56) References Cited

U.S. PATENT DOCUMENTS

2004/0109471 A1* 6/2004 Minde ..... G10L 19/08 370/465
2006/0233379 A1* 10/2006 Villemoes ..... G10L 19/008 381/23
2009/0313028 A1* 12/2009 Tammi ..... G10L 19/265 704/500

(Continued)

OTHER PUBLICATIONS

International Search Report and Written Opinion—PCT/US2017/016418—ISA/EPO—dated Mar. 30, 2017.

*Primary Examiner* — Sonia Gay

(74) *Attorney, Agent, or Firm* — Toler Law Group, P.C.

(57) ABSTRACT

A device includes an encoder and a transmitter. The encoder is configured to determine a mismatch value indicative of an amount of temporal mismatch between a reference channel and a target channel. The encoder is also configured to determine whether to perform a first temporal-shift operation on the target channel at least based on the mismatch value and a coding mode to generate an adjusted target channel. The encoder is further configured to perform a first transform operation on the reference channel to generate a frequency-domain reference channel and perform a second transform operation on the adjusted target channel to generate a frequency-domain adjusted target channel. The encoder is also configured to estimate one or more stereo cues based on the frequency-domain reference channel and the frequency-domain adjusted target channel. The transmitter is configured to transmit the one or more stereo cues to a receiver.

43 Claims, 13 Drawing Sheets

(56) References Cited

U.S. PATENT DOCUMENTS

| | | | | |
|---|---|---|---|---|
| 2010/0198589 | A1* | 8/2010 | Ishikawa | G10L 19/008 704/205 |
| 2011/0096932 | A1* | 4/2011 | Schuijers | G10L 19/008 381/22 |
| 2011/0288872 | A1 | 11/2011 | Liu et al. | |
| 2011/0301962 | A1 | 12/2011 | Wu et al. | |
| 2013/0195276 | A1 | 8/2013 | Ojala | |
| 2013/0301835 | A1 | 11/2013 | Briand et al. | |
| 2014/0195253 | A1 | 7/2014 | Vasilache et al. | |
| 2014/0372107 | A1 | 12/2014 | Vilermo et al. | |

* cited by examiner

ENCODING OF MULTIPLE AUDIO SIGNALS

I. CROSS-REFERENCE TO RELATED APPLICATIONS

The present application claims priority from U.S. Provisional Patent Application No. 62/294,946 entitled "ENCODING OF MULTIPLE AUDIO SIGNALS," filed Feb. 12, 2016, the contents of which are incorporated by reference herein in their entirety.

II. FIELD

The present disclosure is generally related to encoding of multiple audio signals.

III. DESCRIPTION OF RELATED ART

Advances in technology have resulted in smaller and more powerful computing devices. For example, there currently exist a variety of portable personal computing devices, including wireless telephones such as mobile and smart phones, tablets and laptop computers that are small, lightweight, and easily carried by users. These devices can communicate voice and data packets over wireless networks. Further, many such devices incorporate additional functionality such as a digital still camera, a digital video camera, a digital recorder, and an audio file player. Also, such devices can process executable instructions, including software applications, such as a web browser application, that can be used to access the Internet. As such, these devices can include significant computing capabilities.

A computing device may include multiple microphones to receive audio signals. Generally, a sound source is closer to a first microphone than to a second microphone of the multiple microphones. Accordingly, a second audio signal received from the second microphone may be delayed relative to a first audio signal received from the first microphone due to the respective distances of the microphones from the sound source. In other implementations, the first audio signal may be delayed with respect to the second audio signal. In stereo-encoding, audio signals from the microphones may be encoded to generate a mid channel signal and one or more side channel signals. The mid channel signal may correspond to a sum of the first audio signal and the second audio signal. A side channel signal may correspond to a difference between the first audio signal and the second audio signal. The first audio signal may not be aligned with the second audio signal because of the delay in receiving the second audio signal relative to the first audio signal. The misalignment of the first audio signal relative to the second audio signal may increase the difference between the two audio signals. Because of the increase in the difference, a higher number of bits may be used to encode the side channel signal. In some implementations, the first audio signal and the second audio signal may include a low band and high band portion of the signal.

IV. SUMMARY

In a particular implementation, a device includes an encoder and a transmitter. The encoder is configured to determine a mismatch value indicative of an amount of temporal mismatch between a reference channel and a target channel. The encoder is also configured to determine whether to perform a first temporal-shift operation on the target channel at least based on the mismatch value and a coding mode to generate an adjusted target channel. The encoder is further configured to perform a first transform operation on the reference channel to generate a frequency-domain reference channel and perform a second transform operation on the adjusted target channel to generate a frequency-domain adjusted target channel. The encoder is further configured to determine whether to perform a second temporal-shift (e.g., non-causal) operation on the frequency-domain adjusted target channel in the transform-domain based on the first temporal-shift operation to generate a modified frequency-domain adjusted target channel. The encoder is also configured to estimate one or more stereo cues based on the frequency-domain reference channel and the modified frequency-domain adjusted target channel. The transmitter is configured to transmit the one or more stereo cues to a receiver. It should be noted that according to some implementations, a "frequency-domain channel" as used herein may include a sub-band domain, a FFT transform domain, or modified discrete cosine transform (MDCT) domain. In the present disclosure, the terminology used for different variations of the target channel, i.e., "adjusted target channel," "frequency-domain adjusted target channel," "modified frequency-domain adjusted target channel," is for clarity purposes. In some embodiments, the frequency-domain adjusted target channel and the modified frequency-domain adjusted target channel may be very similar. It should be noted that such terms are not to be construed as limiting or the signals are generated in a particular sequence.

In another particular implementation, a method of communication includes determining, at a first device, a mismatch value indicative of an amount of temporal mismatch between a reference channel and a target channel. The method also includes determining whether to perform a first temporal-shift operation on the target channel at least based on the mismatch value and a coding mode to generate an adjusted target channel. The method further includes performing a first transform operation on the reference channel to generate a frequency-domain reference channel and performing a second transform operation on the adjusted target channel to generate a frequency-domain adjusted target channel. The method further includes determining whether to perform a second temporal-shift operation on the frequency-domain adjusted target channel in the transform-domain based on the first temporal-shift operation to generate a modified frequency-domain adjusted target channel. The method also includes estimating one or more stereo cues based on the frequency-domain reference channel and the modified frequency-domain adjusted target channel. The method further includes sending the one or more stereo cues to a second device.

In another particular implementation, a computer-readable storage device stores instructions that, when executed by a processor, cause the processor to perform operations including determining, at a first device, a mismatch value indicative of an amount of temporal mismatch between a reference channel and a target channel. The operations also include determining whether to perform a first temporal-shift operation on the target channel at least based on the mismatch value and a coding mode to generate an adjusted target channel. The operations further include performing a first transform operation on the reference channel to generate a frequency-domain reference channel and performing a second transform operation on the adjusted target channel to generate a frequency-domain adjusted target channel. The operations also include determining whether to perform a second temporal-shift operation on the frequency-domain adjusted target channel in the transform-domain based on the first temporal-shift operation to generate a modified frequency-domain adjusted target channel. The operations also include estimating one or more stereo cues based on the frequency-domain reference channel and the modified frequency-domain adjusted target channel. The operations further include initiating transmission of the one or more stereo cues to a second device.

In another particular implementation, an apparatus includes means for determining a mismatch value indicative of an amount of temporal mismatch between a reference channel and a target channel. The apparatus also includes means for determining whether to perform a first temporal-shift operation on the target channel at least based on the mismatch value and a coding mode to generate an adjusted target channel. The apparatus further includes means for performing a first transform operation on the reference channel to generate a frequency-domain reference channel and means for performing a second transform operation on the adjusted target channel to generate a frequency-domain adjusted target channel. The apparatus also includes means for determining whether to perform a second temporal-shift operation on the frequency-domain adjusted target channel in the transform-domain based on the first temporal-shift operation to generate a modified frequency-domain adjusted target channel. The apparatus also includes means for estimating one or more stereo cues based on the frequency-domain reference channel and the modified frequency-domain adjusted target channel. The apparatus further includes means for sending the one or more stereo cues to a receiver.

Other implementations, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
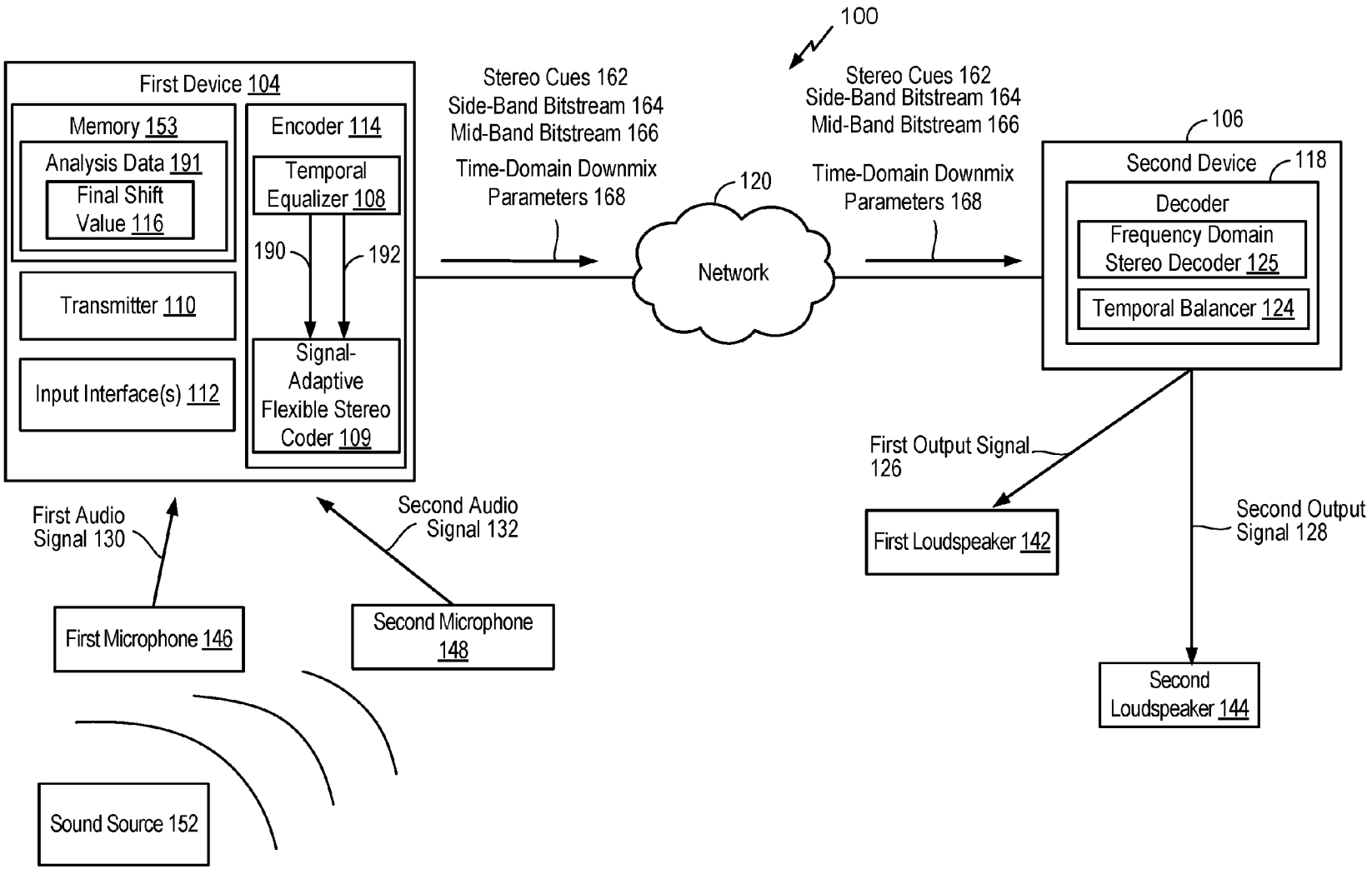
FIG. 1 is a block diagram of a particular illustrative example of a system that includes an encoder operable to encode multiple audio signals.

Systems and devices operable to encode multiple audio signals are disclosed. A device may include an encoder configured to encode the multiple audio signals. The multiple audio signals may be captured concurrently in time using multiple recording devices, e.g., multiple microphones. In some examples, the multiple audio signals (or multi-channel audio) may be synthetically (e.g., artificially) generated by multiplexing several audio channels that are recorded at the same time or at different times. As illustrative examples, the concurrent recording or multiplexing of the audio channels may result in a 2-channel configuration (i.e., Stereo: Left and Right), a 5.1 channel configuration (Left, Right, Center, Left Surround, Right Surround, and the low frequency emphasis (LFE) channels), a 7.1 channel configuration, a 7.1+4 channel configuration, a 22.2 channel configuration, or a N-channel configuration.

Audio capture devices in teleconference rooms (or telepresence rooms) may include multiple microphones that acquire spatial audio. The spatial audio may include speech as well as background audio that is encoded and transmitted. The speech/audio from a given source (e.g., a talker) may arrive at the multiple microphones at different times depending on how the microphones are arranged as well as where the source (e.g., the talker) is located with respect to the microphones and room dimensions. For example, a sound source (e.g., a talker) may be closer to a first microphone associated with the device than to a second microphone associated with the device. Thus, a sound emitted from the sound source may reach the first microphone earlier in time than the second microphone. The device may receive a first audio signal via the first microphone and may receive a second audio signal via the second microphone.

Mid-side (MS) coding and parametric stereo (PS) coding are stereo coding techniques that may provide improved efficiency over the dual-mono coding techniques. In dual-mono coding, the Left (L) channel (or signal) and the Right (R) channel (or signal) are independently coded without making use of inter-channel correlation. MS coding reduces the redundancy between a correlated L/R channel-pair by transforming the Left channel and the Right channel to a sum-channel and a difference-channel (e.g., a side channel) prior to coding. The sum signal and the difference signal are waveform coded or coded based on a model in MS coding. Relatively more bits are spent on the sum signal than on the side signal. PS coding reduces redundancy in each sub-band or frequency-band by transforming the L/R signals into a sum signal and a set of side parameters. The side parameters may indicate an inter-channel intensity difference (IID), an inter-channel phase difference (IPD), an inter-channel time difference (ITD), side or residual prediction gains, etc. The sum signal is waveform coded and transmitted along with the side parameters. In a hybrid system, the side-channel may be waveform coded in the lower bands (e.g., less than 2 kilohertz (kHz)) and PS coded in the upper bands (e.g., greater than or equal to 2 kHz) where the inter-channel phase preservation is perceptually less critical. In some implementations, the PS coding may be used in the lower bands also to reduce the inter-channel redundancy before waveform coding.

The MS coding and the PS coding may be done in either the frequency-domain or in the sub-band domain. In some examples, the Left channel and the Right channel may be uncorrelated. For example, the Left channel and the Right channel may include uncorrelated synthetic signals. When the Left channel and the Right channel are uncorrelated, the coding efficiency of the MS coding, the PS coding, or both, may approach the coding efficiency of the dual-mono coding.

Depending on a recording configuration, there may be a temporal mismatch between a Left channel and a Right channel, as well as other spatial effects such as echo and room reverberation. If the temporal and phase mismatch between the channels are not compensated, the sum channel and the difference channel may contain comparable energies reducing the coding-gains associated with MS or PS techniques. The reduction in the coding-gains may be based on the amount of temporal (or phase) shift. The comparable energies of the sum signal and the difference signal may limit the usage of MS coding in certain frames where the channels are temporally shifted but are highly correlated. In stereo coding, a Mid channel (e.g., a sum channel) and a Side channel (e.g., a difference channel) may be generated based on the following Formula:

$$M=(L+R)/2,\ S=(L-R)/2, \qquad \text{Formula 1}$$

where M corresponds to the Mid channel, S corresponds to the Side channel, L corresponds to the Left channel, and R corresponds to the Right channel.

In some cases, the Mid channel and the Side channel may be generated based on the following Formula:

$$M=c(L+R),\ S=c(L-R), \qquad \text{Formula 2}$$

where c corresponds to a complex value which is frequency dependent. Generating the Mid channel and the Side channel based on Formula 1 or Formula 2 may be referred to as performing a "down-mixing" algorithm. A reverse process of generating the Left channel and the Right channel from the Mid channel and the Side channel based on Formula 1 or Formula 2 may be referred to as performing an "up-mixing" algorithm.

In some cases, the Mid channel may be based other formulas such as:

$$M=(L+g_D R)/2, \text{ or} \qquad \text{Formula 3}$$

$$M=g_1 L+g_2 R \qquad \text{Formula 4}$$

where $g_1+g_2=1.0$, and where $g_D$ is a gain parameter. In other examples, the down-mix may be performed in bands, where $mid(b)=c_1L(b)+c_2R(b)$, where $c_1$ and $c_2$ are complex numbers, where $side(b)=c_3L(b)-c_4R(b)$, and where $c_3$ and $c_4$ are complex numbers.

An ad-hoc approach used to choose between MS coding or dual-mono coding for a particular frame may include generating a mid channel and a side channel, calculating energies of the mid channel and the side channel, and determining whether to perform MS coding based on the energies. For example, MS coding may be performed in response to determining that the ratio of energies of the side channel and the mid channel is less than a threshold. To illustrate, if a Right channel is shifted by at least a first time (e.g., about 0.001 seconds or 48 samples at 48 kHz), a first energy of the mid channel (corresponding to a sum of the left signal and the right signal) may be comparable to a second energy of the side channel (corresponding to a difference between the left signal and the right signal) for voiced speech frames. When the first energy is comparable to the second energy, a higher number of bits may be used to encode the Side channel, thereby reducing coding efficiency of MS coding relative to dual-mono coding. Dual-mono coding may thus be used when the first energy is comparable to the second energy (e.g., when the ratio of the first energy and the second energy is greater than or equal to a threshold). In an alternative approach, the decision between MS coding and dual-mono coding for a particular frame may be made based on a comparison of a threshold and normalized cross-correlation values of the Left channel and the Right channel.

In some examples, the encoder may determine a mismatch value indicative of an amount of temporal mismatch between the first audio signal and the second audio signal. As used herein, a "temporal shift value", a "shift value", and a "mismatch value" may be used interchangeably. For example, the encoder may determine a temporal shift value indicative of a shift (e.g., the temporal mismatch) of the first audio signal relative to the second audio signal. The shift value may correspond to an amount of temporal delay between receipt of the first audio signal at the first microphone and receipt of the second audio signal at the second microphone. Furthermore, the encoder may determine the shift value on a frame-by-frame basis, e.g., based on each 20 milliseconds (ms) speech/audio frame. For example, the shift value may correspond to an amount of time that a second frame of the second audio signal is delayed with respect to a first frame of the first audio signal. Alternatively, the shift value may correspond to an amount of time that the first frame of the first audio signal is delayed with respect to the second frame of the second audio signal.

When the sound source is closer to the first microphone than to the second microphone, frames of the second audio signal may be delayed relative to frames of the first audio signal. In this case, the first audio signal may be referred to as the "reference audio signal" or "reference channel" and the delayed second audio signal may be referred to as the "target audio signal" or "target channel". Alternatively, when the sound source is closer to the second microphone than to the first microphone, frames of the first audio signal may be delayed relative to frames of the second audio signal. In this case, the second audio signal may be referred to as the reference audio signal or reference channel and the delayed first audio signal may be referred to as the target audio signal or target channel.

Depending on where the sound sources (e.g., talkers) are located in a conference or telepresence room or how the sound source (e.g., talker) position changes relative to the microphones, the reference channel and the target channel may change from one frame to another; similarly, the temporal mismatch value may also change from one frame to another. However, in some implementations, the shift value may always be positive to indicate an amount of delay of the "target" channel relative to the "reference" channel. Furthermore, the shift value may correspond to a "non-causal shift" value by which the delayed target channel is "pulled back" in time such that the target channel is aligned (e.g., maximally aligned) with the "reference" channel at the encoder. The down-mix algorithm to determine the mid channel and the side channel may be performed on the reference channel and the non-causal shifted target channel.

The encoder may determine the shift value based on the reference audio channel and a plurality of shift values applied to the target audio channel. For example, a first frame of the reference audio channel, X, may be received at a first time ($m_1$). A first particular frame of the target audio channel, Y, may be received at a second time ($n_1$) corresponding to a first shift value, e.g., $shift1=n_1-m_1$. Further, a second frame of the reference audio channel may be received at a third time ($m_2$). A second particular frame of the target audio channel may be received at a fourth time ($n_2$) corresponding to a second shift value, e.g., $shift2=n_2-m_2$.

The device may perform a framing or a buffering algorithm to generate a frame (e.g., 20 ms samples) at a first sampling rate (e.g., 32 kHz sampling rate (i.e., 640 samples per frame)). The encoder may, in response to determining that a first frame of the first audio signal and a second frame of the second audio signal arrive at the same time at the device, estimate a shift value (e.g., shift1) as equal to zero samples. A Left channel (e.g., corresponding to the first audio signal) and a Right channel (e.g., corresponding to the second audio signal) may be temporally aligned. In some cases, the Left channel and the Right channel, even when aligned, may differ in energy due to various reasons (e.g., microphone calibration).

In some examples, the Left channel and the Right channel may be temporally misaligned due to various reasons (e.g., a sound source, such as a talker, may be closer to one of the microphones than another and the two microphones may be greater than a threshold (e.g., 1-20 centimeters) distance apart). A location of the sound source relative to the microphones may introduce different delays in the first channel and the second channel. In addition, there may be a gain difference, an energy difference, or a level difference between the first channel and the second channel.

In some examples, where there are more than two channels, a reference channel is initially selected based on the levels or energies of the channels, and subsequently refined based on the temporal mismatch values between different pairs of the channels, e.g., t1(ref, ch2), t2(ref, ch3), t3(ref, ch4), . . . t3(ref, chN), where ch1 is the ref channel initially and t1(.), t2(.), etc. are the functions to estimate the mismatch values. If all temporal mismatch values are positive, then ch1 is treated as the reference channel. If any of the mismatch values is a negative value, then the reference channel is reconfigured to the channel that was associated with a mismatch value that resulted in a negative value and the above process is continued until the best selection (i.e., based on maximally decorrelating maximum number of side channels) of the reference channel is achieved. A hysteresis may be used to overcome any sudden variations in reference channel selection.

In some examples, a time of arrival of audio signals at the microphones from multiple sound sources (e.g., talkers) may vary when the multiple talkers are alternatively talking (e.g., without overlap). In such a case, the encoder may dynamically adjust a temporal shift value based on the talker to identify the reference channel. In some other examples, multiple talkers may be talking at the same time, which may result in varying temporal shift values depending on who is the loudest talker, closest to the microphone, etc. In such a case, identification of reference and target channels may be based on the varying temporal shift values in the current frame, the estimated temporal mismatch values in the previous frames, and the energy (or temporal evolution) of the first and second audio signals.

In some examples, the first audio signal and second audio signal may be synthesized or artificially generated when the two signals potentially show less (e.g., no) correlation. It should be understood that the examples described herein are illustrative and may be instructive in determining a relationship between the first audio signal and the second audio signal in similar or different situations.

The encoder may generate comparison values (e.g., difference values or cross-correlation values) based on a comparison of a first frame of the first audio signal and a plurality of frames of the second audio signal. Each frame of the plurality of frames may correspond to a particular shift value. The encoder may generate a first estimated shift value based on the comparison values. For example, the first estimated shift value may correspond to a comparison value indicating a higher temporal-similarity (or lower difference) between the first frame of the first audio signal and a corresponding first frame of the second audio signal.

The encoder may determine the final shift value by refining, in multiple stages, a series of estimated shift values. For example, the encoder may first estimate a "tentative" shift value based on comparison values generated from stereo pre-processed and re-sampled versions of the first audio signal and the second audio signal. The encoder may generate interpolated comparison values associated with shift values proximate to the estimated "tentative" shift value. The encoder may determine a second estimated "interpolated" shift value based on the interpolated comparison values. For example, the second estimated "interpolated" shift value may correspond to a particular interpolated comparison value that indicates a higher temporal-similarity (or lower difference) than the remaining interpolated comparison values and the first estimated "tentative" shift value. If the second estimated "interpolated" shift value of the current frame (e.g., the first frame of the first audio signal) is different than a final shift value of a previous frame (e.g., a frame of the first audio signal that precedes the first frame), then the "interpolated" shift value of the current frame is further "amended" to improve the temporal-similarity between the first audio signal and the shifted second audio signal. In particular, a third estimated "amended" shift value may correspond to a more accurate measure of temporal-similarity by searching around the second estimated "interpolated" shift value of the current frame and the final estimated shift value of the previous frame. The third estimated "amended" shift value is further conditioned to estimate the final shift value by limiting any spurious changes in the shift value between frames and further controlled to not switch from a negative shift value to a positive shift value (or vice versa) in two successive (or consecutive) frames as described herein.

In some examples, the encoder may refrain from switching between a positive shift value and a negative shift value or vice-versa in consecutive frames or in adjacent frames. For example, the encoder may set the final shift value to a particular value (e.g., 0) indicating no temporal-shift based on the estimated "interpolated" or "amended" shift value of the first frame and a corresponding estimated "interpolated" or "amended" or final shift value in a particular frame that precedes the first frame. To illustrate, the encoder may set the final shift value of the current frame (e.g., the first frame) to indicate no temporal-shift, i.e., shift1=0, in response to determining that one of the estimated "tentative" or "interpolated" or "amended" shift value of the current frame is positive and the other of the estimated "tentative" or "interpolated" or "amended" or "final" estimated shift value of the previous frame (e.g., the frame preceding the first frame) is negative. Alternatively, the encoder may also set the final shift value of the current frame (e.g., the first frame) to indicate no temporal-shift, i.e., shift1=0, in response to determining that one of the estimated "tentative" or "interpolated" or "amended" shift value of the current frame is negative and the other of the estimated "tentative" or "interpolated" or "amended" or "final" estimated shift value of the previous frame (e.g., the frame preceding the first frame) is positive.

The encoder may select a frame of the first audio signal or the second audio signal as a "reference" or "target" based on the shift value. For example, in response to determining that the final shift value is positive, the encoder may generate a reference channel or signal indicator having a first value (e.g., 0) indicating that the first audio signal is a "reference" channel and that the second audio signal is the "target" channel. Alternatively, in response to determining that the final shift value is negative, the encoder may generate the reference channel or signal indicator having a second value (e.g., 1) indicating that the second audio signal is the "reference" channel and that the first audio signal is the "target" channel.

The encoder may estimate a relative gain (e.g., a relative gain parameter) associated with the reference channel and the non-causal shifted target channel. For example, in response to determining that the final shift value is positive, the encoder may estimate a gain value to normalize or equalize the energy or power levels of the first audio signal relative to the second audio signal that is offset by the non-causal shift value (e.g., an absolute value of the final shift value). Alternatively, in response to determining that the final shift value is negative, the encoder may estimate a gain value to normalize or equalize the power or amplitude levels of the first audio signal relative to the second audio signal. In some examples, the encoder may estimate a gain value to normalize or equalize the amplitude or power levels of the "reference" channel relative to the non-causal shifted "target" channel. In other examples, the encoder may estimate the gain value (e.g., a relative gain value) based on the reference channel relative to the target channel (e.g., the unshifted target channel).

The encoder may generate at least one encoded signal (e.g., a mid channel, a side channel, or both) based on the reference channel, the target channel, the non-causal shift value, and the relative gain parameter. In other implementations, the encoder may generate at least one encoded signal (e.g., a mid channel, a side channel, or both) based on the reference channel and the temporal-mismatch adjusted target channel. The side channel may correspond to a difference between first samples of the first frame of the first audio signal and selected samples of a selected frame of the second audio signal. The encoder may select the selected frame based on the final shift value. Fewer bits may be used to encode the side channel signal because of reduced difference between the first samples and the selected samples as compared to other samples of the second audio signal that correspond to a frame of the second audio signal that is received by the device at the same time as the first frame. A transmitter of the device may transmit the at least one encoded signal, the non-causal shift value, the relative gain parameter, the reference channel or signal indicator, or a combination thereof.

The encoder may generate at least one encoded signal (e.g., a mid channel, a side channel, or both) based on the reference channel, the target channel, the non-causal shift value, the relative gain parameter, low band parameters of a particular frame of the first audio signal, high band parameters of the particular frame, or a combination thereof. The particular frame may precede the first frame. Certain low band parameters, high band parameters, or a combination thereof, from one or more preceding frames may be used to encode a mid channel, a side channel, or both, of the first frame. Encoding the mid channel, the side channel, or both, based on the low band parameters, the high band parameters, or a combination thereof, may include estimates of the non-causal shift value and inter-channel relative gain parameter. The low band parameters, the high band parameters, or a combination thereof, may include a pitch parameter, a voicing parameter, a coder type parameter, a low-band energy parameter, a high-band energy parameter, a tilt parameter, a pitch gain parameter, a FCB gain parameter, a coding mode parameter, a voice activity parameter, a noise estimate parameter, a signal-to-noise ratio parameter, a formant shaping parameter, a speech/music decision parameter, the non-causal shift, the inter-channel gain parameter, or a combination thereof. A transmitter of the device may transmit the at least one encoded signal, the non-causal shift value, the relative gain parameter, the reference channel (or signal) indicator, or a combination thereof.

In the present disclosure, terms such as "determining", "calculating", "shifting", "adjusting", etc. may be used to describe how one or more operations are performed. It should be noted that such terms are not to be construed as limiting and other techniques may be utilized to perform similar operations.

Referring to FIG. 1, a particular illustrative example of a system is disclosed and generally designated 100. The system 100 includes a first device 104 communicatively coupled, via a network 120, to a second device 106. The network 120 may include one or more wireless networks, one or more wired networks, or a combination thereof.

The first device 104 may include an encoder 114, a transmitter 110, one or more input interfaces 112, or a combination thereof. A first input interface of the input interfaces 112 may be coupled to a first microphone 146. A second input interface of the input interface(s) 112 may be coupled to a second microphone 148. The encoder 114 may include a temporal equalizer 108 and a time-domain (TD), frequency-domain (FD), and an modified-discrete cosine transform (MDCT) based signal-adaptive "flexible" stereo coder 109. The signal-adaptive flexible stereo coder 109 and may be configured to down-mix and encode multiple audio signals, as described herein. The first device 104 may also include a memory 153 configured to store analysis data 191. The second device 106 may include a decoder 118. The decoder 118 may include a temporal balancer 124 that is configured to up-mix and render the multiple channels. The second device 106 may be coupled to a first loudspeaker 142, a second loudspeaker 144, or both.

During operation, the first device 104 may receive a first audio signal 130 via the first input interface from the first microphone 146 and may receive a second audio signal 132 via the second input interface from the second microphone 148. The first audio signal 130 may correspond to one of a right channel signal or a left channel signal. The second audio signal 132 may correspond to the other of the right channel signal or the left channel signal. A sound source 152 (e.g., a user, a speaker, ambient noise, a musical instrument, etc.) may be closer to the first microphone 146 than to the second microphone 148. Accordingly, an audio signal from the sound source 152 may be received at the input interface(s) 112 via the first microphone 146 at an earlier time than via the second microphone 148. This natural delay in the multi-channel signal acquisition through the multiple microphones may introduce a temporal shift between the first audio signal 130 and the second audio signal 132.

The temporal equalizer 108 may determine a mismatch value (e.g., the "final shift value" 116 or "non-causal shift value") indicative of an amount of temporal mismatch between a reference channel and a target channel. According to one implementation, the first audio signal 130 is the reference channel and the second audio signal 132 is the target channel. According to another implementation, the second audio signal 132 is the reference channel and the first audio signal 130 is the target channel. The reference channel and the target channel may switch on a frame-to-frame basis. As a non-limiting example, if a frame of the first audio signal 130 arrives at the first microphone 146 prior to a corresponding frame of the second audio signal 132 arriving at the second microphone 148, the first audio signal 130 may be the reference channel and the second audio signal 132 may be the target channel. Alternatively, if a frame of the second audio signal 132 arrives at the second microphone 148 prior to a corresponding frame of the first audio signal 130 arriving at the first microphone 146, the second audio signal 132 may be the reference channel and the first audio signal 130 may be the target channel. The target channel may correspond to a lagging audio channel of the two audio signals 130, 132 and the reference channel may correspond to a leading audio channel of the two audio signals 130, 132. Thus, the designation of the reference channel and the target channel may depend on the location of the sound source 152 with respect to the microphone 146, 148.

A first value (e.g., a positive value) of the final shift value 116 may indicate that the second audio signal 132 is delayed relative to the first audio signal 130. A second value (e.g., a negative value) of the final shift value 116 may indicate that the first audio signal 130 is delayed relative to the second audio signal 132. A third value (e.g., 0) of the final shift value 116 may indicate no delay between the first audio signal 130 and the second audio signal 132.

In some implementations, the third value (e.g., 0) of the final shift value 116 may indicate that delay between the first audio signal 130 and the second audio signal 132 has switched sign. For example, a first particular frame of the first audio signal 130 may precede the first frame. The first particular frame and a second particular frame of the second audio signal 132 may correspond to the same sound emitted by the sound source 152. The delay between the first audio signal 130 and the second audio signal 132 may switch from having the first particular frame delayed with respect to the second particular frame to having the second frame delayed with respect to the first frame. Alternatively, the delay between the first audio signal 130 and the second audio signal 132 may switch from having the second particular frame delayed with respect to the first particular frame to having the first frame delayed with respect to the second frame. The temporal equalizer 108 may set the final shift value 116 to indicate the third value (e.g., 0), in response to determining that the delay between the first audio signal 130 and the second audio signal 132 has switched sign.

The temporal equalizer 108 may generate a reference channel indicator based on the final shift value 116. For example, the temporal equalizer 108 may, in response to determining that the final shift value 116 indicates a first value (e.g., a positive value), generate the reference channel indicator to have a first value (e.g., 0) indicating that the first audio signal 130 is a "reference" channel 190. The temporal equalizer 108 may determine that the second audio signal 132 corresponds to a "target" channel (not shown) in response to determining that the final shift value 116 indicates the first value (e.g., a positive value). Alternatively, the temporal equalizer 108 may, in response to determining that the final shift value 116 indicates a second value (e.g., a negative value), generate the reference channel indicator to have a second value (e.g., 1) indicating that the second audio signal 132 is the "reference" channel 190. The temporal equalizer 108 may determine that the first audio signal 130 corresponds to the "target" channel in response to determining that the final shift value 116 indicates the second value (e.g., a negative value). The temporal equalizer 108 may, in response to determining that the final shift value 116 indicates a third value (e.g., 0), generate the reference channel indicator to have a first value (e.g., 0) indicating that the first audio signal 130 is the "reference" channel 190. The temporal equalizer 108 may determine that the second audio signal 132 corresponds to the "target" channel in response to determining that the final shift value 116 indicates the third value (e.g., 0). Alternatively, the temporal equalizer 108 may, in response to determining that the final shift value 116 indicates the third value (e.g., 0), generate the reference channel indicator to have a second value (e.g., 1) indicating that the second audio signal 132 is the "reference" channel 190. The temporal equalizer 108 may determine that the first audio signal 130 corresponds to a "target" channel in response to determining that the final shift value 116 indicates the third value (e.g., 0). In some implementations, the temporal equalizer 108 may, in response to determining that the final shift value 116 indicates a third value (e.g., 0), leave the reference channel indicator unchanged. For example, the reference channel indicator may be the same as a reference channel indicator corresponding to the first particular frame of the first audio signal 130. The temporal equalizer 108 may generate a non-causal shift value indicating an absolute value of the final shift value 116.

The temporal equalizer 108 may generate a target channel indicator based on the target channel, the reference channel 190, a first shift value (e.g., a shift value for a previous frame), the final shift value 116, the reference channel indicator, or a combination thereof. The target channel indicator may indicate which of the first audio signal 130 or the second audio signal 132 is the target channel. The temporal equalizer 108 may determine whether to temporally-shift the target channel to generate an adjusted target channel 192 based at least on the target channel indicator, the target channel, a stereo downmix or coding mode, or a combination thereof. For example, the temporal equalizer 108 may adjust the target channel (e.g., the first audio signal 130 or the second audio signal 132) based on a temporal shift evolution from the first shift value to the final shift value 116. The temporal equalizer 108 may interpolate the target channel such that a subset of samples of the target channel that correspond to frame boundaries are dropped through smoothing and slow-shifting to generate the adjusted target channel 192.

Thus, the temporal equalizer 108 may time-shift the target channel to generate the adjusted target channel 192 such that the reference channel 190 and the adjusted target channel 192 are substantially synchronized. The temporal equalizer 108 may generate time-domain down-mix parameters 168. The time-domain down-mix parameters may indicate a shift value between the target channel and the reference channel 190. In other implementations, the time-domain down-mix parameters may include additional parameters like a down-mix gain etc. For example, the time-domain down-mix parameters 168 may include a first shift value 262, a reference channel indicator 264, or both, as further described with reference to FIG. 2. The temporal equalizer 108 is described in greater detail with respect to FIG. 2. The temporal equalizer 108 may provide the reference channel 190 and the adjusted target channel 192 to the time-domain or frequency-domain or a hybrid independent channel (e.g., dual mono) stereo coder 109, as shown.

The signal-adaptive "flexible" stereo coder 109 may transform one or more time-domain signals (e.g., the reference channel 190 and the adjusted target channel 192) into frequency-domain signals. The signal-adaptive "flexible" stereo coder 109 is further configured to determine whether to perform a second temporal-shift (e.g., non-causal) operation on the frequency-domain adjusted target channel in the transform-domain based on the first temporal-shift operation to generate a modified frequency-domain adjusted target channel. The time-domain signals, 190, 192 and the frequency-domain signals may be used to estimate stereo cues 162. The stereo cues 162 may include parameters that enable rendering of spatial properties associated with left channels and right channels. According to some implementations, the stereo cues 162 may include parameters such as interchannel intensity difference (IID) parameters (e.g., interchannel level differences (ILDs), interchannel time difference (ITD) parameters, interchannel phase difference (IPD) parameters, temporal mismatch or non-causal shift parameters, spectral tilt parameters, inter-channel voicing parameters, inter-channel pitch parameters, inter-channel gain parameters, etc. The stereo cues 162 may be used at the signal adaptive "flexible" stereo coder 109 during generation of other signals. The stereo cues 162 may also be transmitted as part of an encoded signal. Estimation and use of the stereo cues 162 is described in greater detail with respect to FIGS. 3-7.

The signal adaptive "flexible" stereo coder 109 may also generate a side-band bit-stream 164 and a mid-band bit-stream 166 based at least in part on the frequency-domain signals. For purposes of illustration, unless otherwise noted, it is assumed that that the reference channel 190 is a left-channel signal (l or L) and the adjusted target channel 192 is a right-channel signal (r or R). The frequency-domain representation of the reference channel 190 may be noted as $L_{fr}(b)$ and the frequency-domain representation of the adjusted target channel 192 may be noted as $R_{fr}(b)$, where b represents a band of the frequency-domain representations. According to one implementation, a side-band channel $S_{fr}(b)$ may be generated in the frequency-domain from frequency-domain representations of the reference channel 190 and the adjusted target channel 192. For example, the side-band channel $S_{fr}(b)$ may be expressed as $(L_{fr}(b)-R_{fr}(b))/2$. The side-band channel $S_{fr}(b)$ may be provided to a side-band encoder to generate the side-band bit-stream 164. According to one implementation, a mid-band channel m(t) may be generated in the time-domain and transformed into the frequency-domain. For example, the mid-band channel m(t) may be expressed as (l(t)+r(t))/2. Generating the mid-band channel in the time-domain prior to generation of the mid-band channel in the frequency-domain is described in greater detail with respect to FIGS. 3,4 and 7. According to another implementation, a mid-band channel $M_{fr}(b)$ may be generated from frequency-domain signals (e.g., bypassing time-domain mid-band channel generation). Generating the mid-band channel $M_{fr}(b)$ from frequency-domain signals is described in greater detail with respect to FIGS. 5-6. The time-domain/frequency-domain mid-band channels may be provided to a mid-band encoder to generate the mid-band bit-stream 166.

The side-band channel $S_{fr}(b)$ and the mid-band channel m(t) or $M_{fr}(b)$ may be encoded using multiple techniques. According to one implementation, the time-domain mid-band channel m(t) may be encoded using a time-domain technique, such as algebraic code-excited linear prediction (ACELP), with a bandwidth extension for higher band coding. Before side-band coding, the mid-band channel m(t) (either coded or uncoded) may be converted into the frequency-domain (e.g., the transform-domain) to generate the mid-band channel $M_{fr}(b)$.

One implementation of side-band coding includes predicting a side-band $S_{PRED}(b)$ from the frequency-domain mid-band channel $M_{fr}(b)$ using the information in the frequency mid-band channel $M_{fr}(b)$ and the stereo cues 162 (e.g., ILDs) corresponding to the band (b). For example, the predicted side-band $S_{PRED}(b)$ may be expressed as $M_{fr}(b)*(ILD(b)-1)/(ILD(b)+1)$. An error signal e may be calculated as a function of the side-band channel $S_{fr}$ and the predicted side-band $S_{PRED}$. For example, the error signal e may be expressed as $S_{fr}-S_{PRED}$ or $S_{fr}$. The error signal e may be coded using time-domain or transform-domain coding techniques to generate a coded error signal $e_{CODED}$. For certain bands, the error signal e may be expressed as a scaled version of a mid-band channel $M_PAST_{fr}$ in those bands from a previous frame. For example, the coded error signal $e_{CODED}$ may be expressed as $g_{PRED}*M_PAST_{fr}$, where $g_{PRED}$ may be estimated such that an energy of $e-g_{PRED}*M_PAST_{fr}$ is substantially reduced (e.g., minimized). The M_PAST frame that is used can be based on the window shape used for analysis/synthesis and may be constrained to use only even window hops.

The transmitter 110 may transmit the stereo cues 162, the side-band bit-stream 164, the mid-band bit-stream 166, the time-domain down-mix parameters 168, or a combination thereof, via the network 120, to the second device 106. Alternatively, or in addition, the transmitter 110 may store the stereo cues 162, the side-band bit-stream 164, the mid-band bit-stream 166, the time-domain down-mix parameters 168, or a combination thereof, at a device of the network 120 or a local device for further processing or decoding later. Because a non-causal shift (e.g., the final shift value 116) may be determined during the encoding process, transmitting IPDs (e.g., as part of the stereo cues 162) in addition to the non-causal shift in each band may be redundant. Thus, in some implementations, an IPD and non-casual shift may be estimated for the same frame but in mutually exclusive bands. In other implementations, lower resolution IPDs may be estimated in addition to the shift for finer per-band adjustments. Alternatively, IPDs may be not determined for frames where the non-casual shift is determined. In some other embodiments, the IPDs may be determined but not used or reset to zero, where non-causal shift satisfies a threshold.

The decoder 118 may perform decoding operations based on the stereo cues 162, the side-band bit-stream 164, the mid-band bit-stream 166, and the time-domain down-mix parameters 168. For example, a frequency-domain stereo decoder 125 and the temporal balancer 124 may perform up-mixing to generate a first output signal 126 (e.g., corresponding to first audio signal 130), a second output signal 128 (e.g., corresponding to the second audio signal 132), or both. The second device 106 may output the first output signal 126 via the first loudspeaker 142. The second device 106 may output the second output signal 128 via the second loudspeaker 144. In alternative examples, the first output signal 126 and second output signal 128 may be transmitted as a stereo signal pair to a single output loudspeaker.

The system 100 may thus enable signal adaptive "flexible" stereo coder 109 to transform the reference channel 190 and the adjusted target channel 192 into the frequency-domain to generate the stereo cues 162, the side-band bit-stream 164, and the mid-band bit-stream 166. The time-shifting techniques of the temporal equalizer 108 that temporally shift the first audio signal 130 to align with the second audio signal 132 may be implemented in conjunction with frequency-domain signal processing. To illustrate, temporal equalizer 108 estimates a shift (e.g., a non-casual shift value) for each frame at the encoder 114, shifts (e.g., adjusts) a target channel according to the non-casual shift value, and uses the shift adjusted channels for the stereo cues estimation in the transform-domain.

Figure 2:
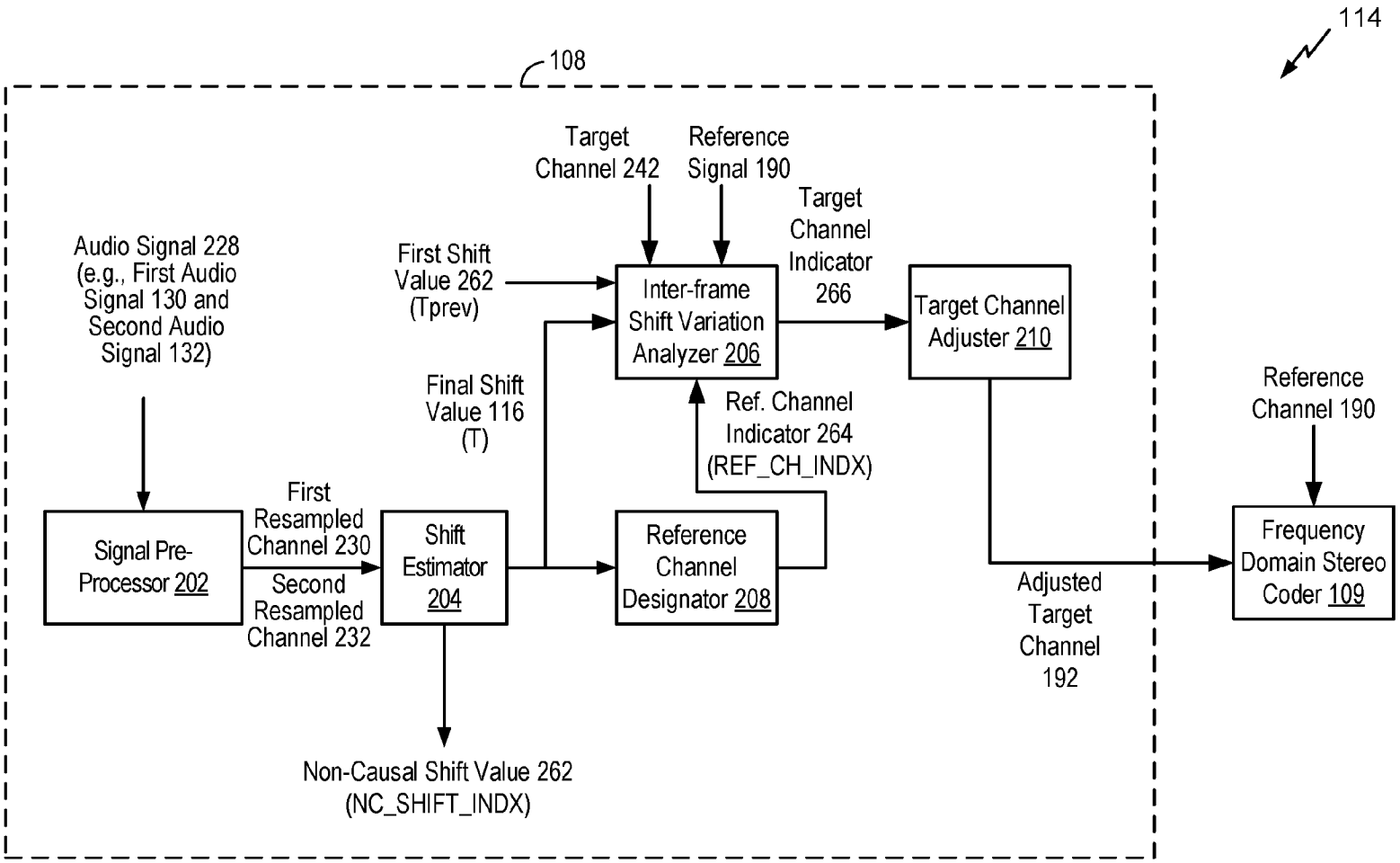
FIG. 2 is a diagram illustrating the encoder of FIG. 1.

Referring to FIG. 2, an illustrative example of the encoder 114 of the first device 104 is shown. The encoder 114 includes the temporal equalizer 108 and the signal-adaptive "flexible" stereo coder 109.

The temporal equalizer 108 includes a signal pre-processor 202 coupled, via a shift estimator 204, to an inter-frame shift variation analyzer 206, to a reference channel designator 208, or both. In a particular implementation, the signal pre-processor 202 may correspond to a resampler. The inter-frame shift variation analyzer 206 may be coupled, via a target channel adjuster 210, to the signal-adaptive "flexible" stereo coder 109. The reference channel designator 208 may be coupled to the inter-frame shift variation analyzer 206. Based on the temporal mismatch value, the TD stereo, the frequency-domain stereo, or the MDCT stereo downmix is used in the signal-adaptive "flexible" stereo coder 109.

During operation, the signal pre-processor 202 may receive an audio signal 228. For example, the signal pre-processor 202 may receive the audio signal 228 from the input interface(s) 112. The audio signal 228 may include the first audio signal 130, the second audio signal 132, or both. The signal pre-processor 202 may generate a first resampled channel 230, a second resampled channel 232, or both. Operations of the signal pre-processor 202 are described in greater detail with respect to FIG. 8. The signal pre-processor 202 may provide the first resampled channel 230, the second resampled channel 232, or both, to the shift estimator 204.

The shift estimator 204 may generate the final shift value 116 (T), the non-causal shift value, or both, based on the first resampled channel 230, the second resampled channel 232, or both. Operations of the shift estimator 204 are described in greater detail with respect to FIG. 9. The shift estimator 204 may provide the final shift value 116 to the inter-frame shift variation analyzer 206, the reference channel designator 208, or both.

The reference channel designator 208 may generate a reference channel indicator 264. The reference channel indicator 264 may indicate which of the audio signals 130, 132 is the reference channel 190 and which of the signals 130, 132 is the target channel 242. The reference channel designator 208 may provide the reference channel indicator 264 to the inter-frame shift variation analyzer 206.

The inter-frame shift variation analyzer 206 may generate a target channel indicator 266 based on the target channel 242, the reference channel 190, a first shift value 262 (Tprev), the final shift value 116 (T), the reference channel indicator 264, or a combination thereof. The inter-frame shift variation analyzer 206 may provide the target channel indicator 266 to the target channel adjuster 210.

The target channel adjuster 210 may generate the adjusted target channel 192 based on the target channel indicator 266, the target channel 242, or both. The target channel adjuster 210 may adjust the target channel 242 based on a temporal shift evolution from the first shift value 262 (Tprev) to the final shift value 116 (T). For example, the first shift value 262 may include a final shift value corresponding to the previous frame. The target channel adjuster 210 may, in response to determining that a final shift value changed from the first shift value 262 having a first value (e.g., Tprev=2) corresponding to the previous frame that is lower than the final shift value 116 (e.g., T=4) corresponding to the previous frame, interpolate the target channel 242 such that a subset of samples of the target channel 242 that correspond to frame boundaries are dropped through smoothing and slow-shifting to generate the adjusted target channel 192. Alternatively, the target channel adjuster 210 may, in response to determining that a final shift value changed from the first shift value 262 (e.g., Tprev=4) that is greater than the final shift value 116 (e.g., T=2), interpolate the target channel 242 such that a subset of samples of the target channel 242 that correspond to frame boundaries are repeated through smoothing and slow-shifting to generate the adjusted target channel 192. The smoothing and slow-shifting may be performed based on hybrid Sinc- and Lagrange-interpolators. The target channel adjuster 210 may, in response to determining that a final shift value is unchanged from the first shift value 262 to the final shift value 116 (e.g., Tprev=T), temporally offset the target channel 242 to generate the adjusted target channel 192. The target channel adjuster 210 may provide the adjusted target channel 192 to the signal-adaptive "flexible" stereo coder 109.

The reference channel 190 may also be provided to the signal-adaptive "flexible" stereo coder 109. The signal-adaptive "flexible" stereo coder 109 may generate the stereo cues 162, the side-band bit-stream 164, and the mid-band bit-stream 166 based on the reference channel 190 and the adjusted target channel 192, as described with respect to FIG. 1 and as further described with respect to FIGS. 3-7.

Referring to FIGS. 3-7, a few example detailed implementations **109*a*-109*e* of signal-adaptive "flexible" stereo coder 109 working in conjunction with the time-domain down-mixing operations as described in FIG. 2 are shown. In some examples, the reference channel 190 may include a left-channel signal and the adjusted target channel 192 may include a right-channel signal. However, it should be understood that in other examples, the reference channel 190 may include a right-channel signal and the adjusted target channel 192 may include a left-channel signal. In other implementations, the reference channel 190 may be either of the left or the right channel which is chosen on a frame-by-frame basis and similarly, the adjusted target channel 192 may be the other of the left or right channels after being adjusted for temporal mismatch. For the purposes of the descriptions below, we provide examples of the specific case when the reference channel 190 includes a left-channel signal (L) and the adjusted target channel 192 includes a right-channel signal (R). Similar descriptions for the other cases can be trivially extended. It is also to be understood that the various components illustrated in FIGS. 3-7** (e.g., transforms, signal generators, encoders, estimators, etc.) may be implemented using hardware (e.g., dedicated circuitry), software (e.g., instructions executed by a processor), or a combination thereof.

Figure 3:
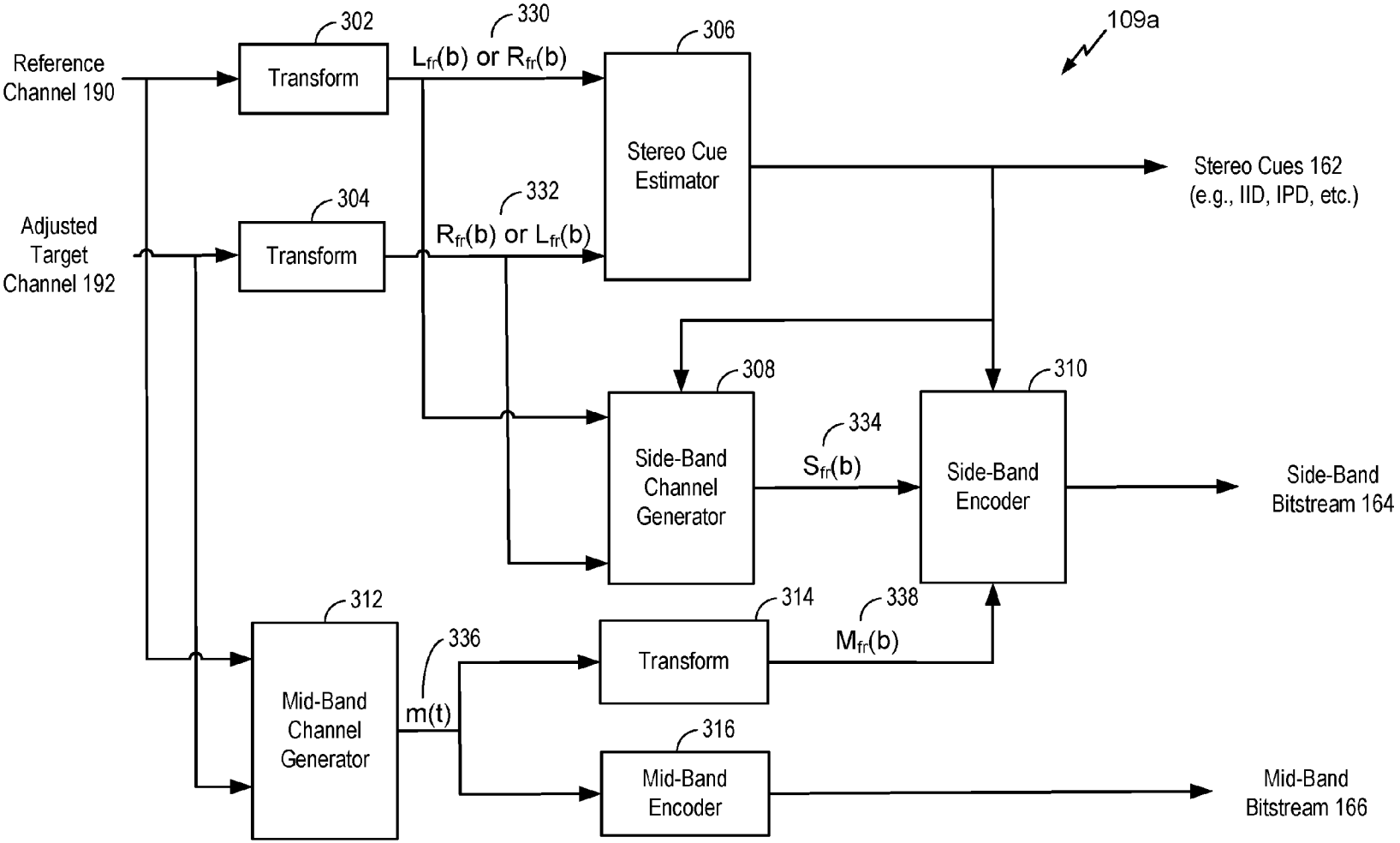
FIG. 3 is a diagram illustrating a first implementation of a frequency-domain stereo coder of the encoder of FIG. 1.

In FIG. 3, a transform 302 may be performed on the reference channel 190 and a transform 304 may be performed on the adjusted target channel 192. The transforms 302, 304 may be performed by transform operations that generate frequency-domain (or sub-band domain) signals. As non-limiting examples, performing the transforms 302, 304 may performing include Discrete Fourier Transform (DFT) operations, Fast Fourier Transform (FFT) operations, MDCT operations, etc. According to some implementations, Quadrature Mirror Filterbank (QMF) operations (using filterbands, such as a Complex Low Delay Filter Bank) may be used to split the input signals (e.g., the reference channel 190 and the adjusted target channel 192) into multiple sub-bands. The transform 302 may be applied to the reference channel 190 to generate a frequency-domain reference channel ($L_{fr}$(b)) 330, and the transform 304 may be applied to the adjusted target channel 192 to generate a frequency-domain adjusted target channel ($R_{fr}$(b)) 332. The signal-adaptive "flexible" stereo coder **109*a* is further configured to determine whether to perform a second temporal-shift (e.g., non-causal) operation on the frequency-domain adjusted target channel in the transform-domain based on the first temporal-shift operation to generate a modified frequency-domain adjusted target channel 332. The frequency-domain reference channel 330 and the (modified) frequency-domain adjusted target channel 332 may be provided to a stereo cue estimator 306 and to a side-band channel generator 308**.

The stereo cue estimator 306 may extract (e.g., generate) the stereo cues 162 based on the frequency-domain reference channel 330 and the frequency-domain adjusted target channel 332. To illustrate, IID(b) may be a function of the energies $E_L(b)$ of the left channels in the band (b) and the energies $E_R(b)$ of the right channels in the band (b). For example, IID(b) may be expressed as $20*\log_{10}(E_L(b)/E_R(b))$. IPDs estimated and transmitted at an encoder may provide an estimate of the phase difference in the frequency-domain between the left and right channels in the band (b). The stereo cues 162 may include additional (or alternative) parameters, such as ICCs, ITDs etc. The stereo cues 162 may be transmitted to the second device 106 of FIG. 1, provided to the side-band channel generator 308, and provided to a side-band encoder 310.

The side-band generator 308 may generate a frequency-domain side-band channel ($S_{fr}(b)$) 334 based on the frequency-domain reference channel 330 and the (modified) frequency-domain adjusted target channel 332. The frequency-domain side-band channel 334 may be estimated in the frequency-domain bins/bands. In each band, the gain parameter (g) is different and may be based on the inter-channel level differences (e.g., based on the stereo cues 162). For example, the frequency-domain side-band channel 334 may be expressed as $(L_{fr}(b)-c(b)*R_{fr}(b))/(1+c(b))$, where c(b) may be the ILD(b) or a function of the ILD(b) (e.g., c(b)=10^(ILD(b)/20)). The frequency-domain side-band channel 334 may be provided to the side-band encoder 310.

The reference channel 190 and the adjusted target channel 192 may also be provided to a mid-band channel generator 312. The mid-band channel generator 312 may generate a time-domain mid-band channel (m(t)) 336 based on the reference channel 190 and the adjusted target channel 192. For example, the time-domain mid-band channel 336 may be expressed as (l(t)+r(t)))/2, where l(t) includes the reference channel 190 and r(t) includes the adjusted target channel 192. A transform 314 may be applied to time-domain mid-band channel 336 to generate a frequency-domain mid-band channel ($M_{fr}(b)$) 338, and the frequency-domain mid-band channel 338 may be provided to the side-band encoder 310. The time-domain mid-band channel 336 may be also provided to a mid-band encoder 316.

The side-band encoder 310 may generate the side-band bit-stream 164 based on the stereo cues 162, the frequency-domain side-band channel 334, and the frequency-domain mid-band channel 338. The mid-band encoder 316 may generate the mid-band bit-stream 166 by encoding the time-domain mid-band channel 336. In particular examples, the side-band encoder 310 and the mid-band encoder 316 may include ACELP encoders to generate the side-band bit-stream 164 and the mid-band bit-stream 166, respectively. For the lower bands, the frequency-domain side-band channel 334 may be encoded using a transform-domain coding technique. For the higher bands, the frequency-domain side-band channel 334 may be expressed as a prediction from the previous frame's mid-band channel (either quantized or unquanitized).

Figure 4:
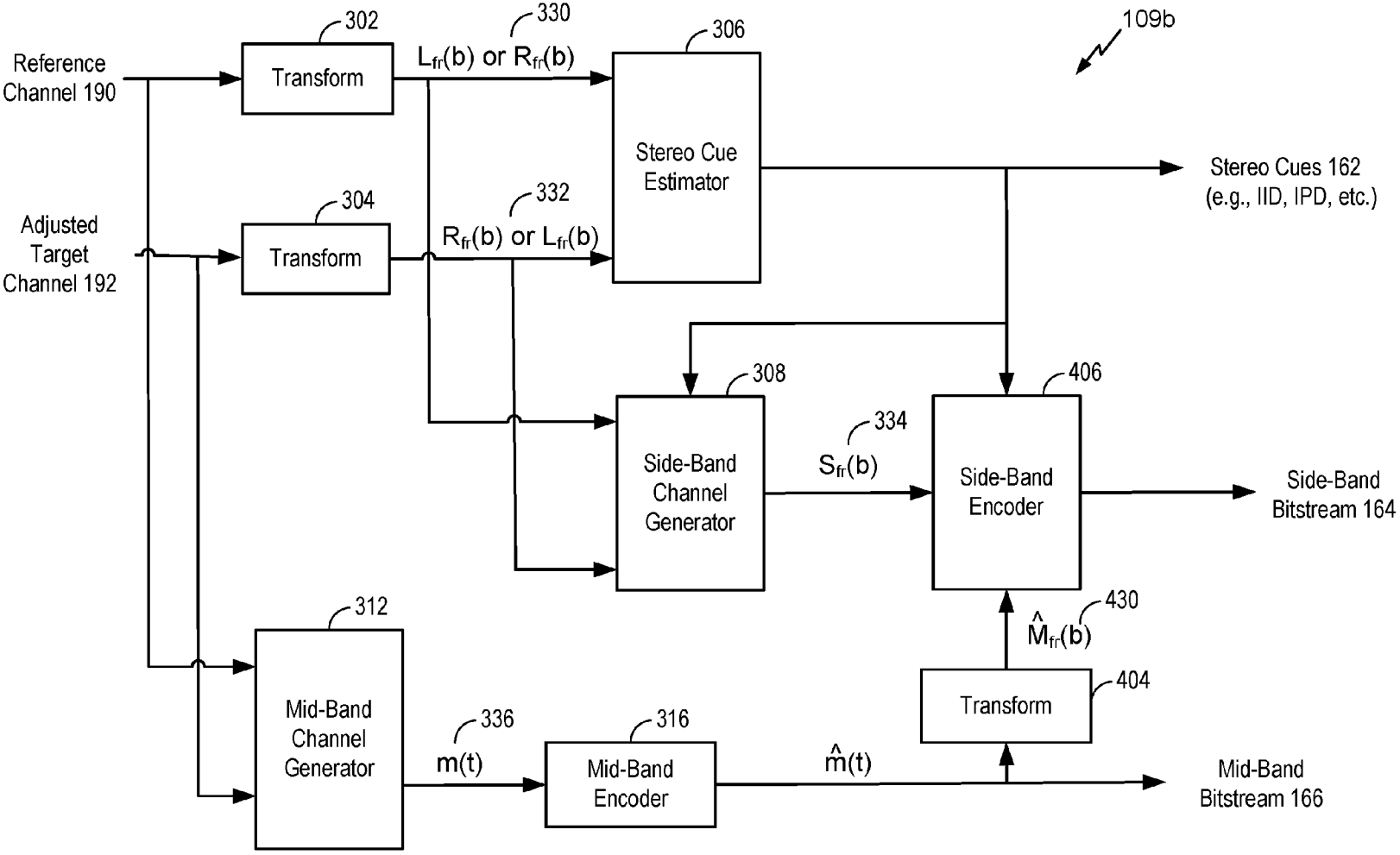
FIG. 4 is a diagram illustrating a second implementation of a frequency-domain stereo coder of the encoder of FIG. 1.

Referring to FIG. 4, a second implementation 109*b* of the signal-adaptive "flexible" stereo coder 109 is shown. The second implementation 109*b* of the signal-adaptive "flexible" stereo coder 109 may operate in a substantially similar manner as the first implementation 109*a* of the signal-adaptive "flexible" stereo coder 109. However, in the second implementation 109*b*, a transform 404 may be applied to the mid-band bit-stream 166 (e.g., an encoded version of the time-domain mid-band channel 336) to generate a frequency-domain mid-band bit-stream 430. A side-band encoder 406 may generate the side-band bit-stream 164 based on the stereo cues 162, the frequency-domain side-band channel 334, and the frequency-domain mid-band bit-stream 430.

Figure 5:
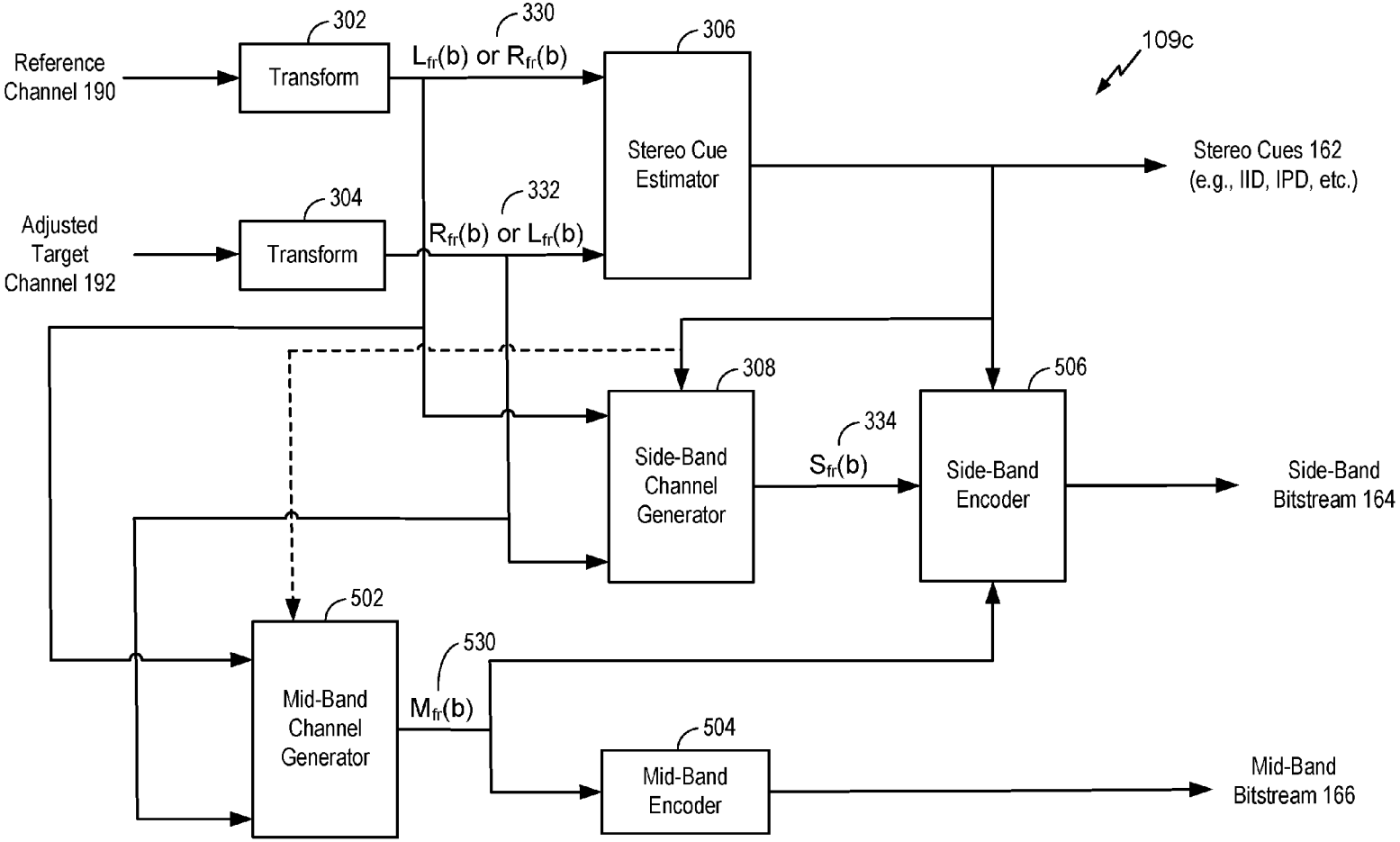
FIG. 5 is a diagram illustrating a third implementation of a frequency-domain stereo coder of the encoder of FIG. 1.

Referring to FIG. 5, a third implementation 109*c* of the signal-adaptive "flexible" stereo coder 109 is shown. The third implementation 109*c* of the signal-adaptive "flexible" stereo coder 109 may operate in a substantially similar manner as the first implementation 109*a* of the signal-adaptive "flexible" stereo coder 109. However, in the third implementation 109*c*, the frequency-domain reference channel 330 and the frequency-domain adjusted target channel 332 may be provided to a mid-band channel generator 502. The signal-adaptive "flexible" stereo coder 109*c* is further configured to determine whether to perform a second temporal-shift (e.g., non-causal) operation on the frequency-domain adjusted target channel in the transform-domain based on the first temporal-shift operation to generate a modified frequency-domain adjusted target channel 332. According to some implementations, the stereo cues 162 may also be provided to the mid-band channel generator 502. The mid-band channel generator 502 may generate a frequency-domain mid-band channel $M_{fr}(b)$ 530 based on the frequency-domain reference channel 330 and the frequency-domain adjusted target channel 332. According to some implementations, the frequency-domain mid-band channel $M_{fr}(b)$ 530 may be generated also based on the stereo cues 162. Some methods of generation of the mid-band channel 530 based on the frequency-domain reference channel 330, the adjusted target channel 332 and the stereo cues 162 are as follows.

$$M_{fr}(b)=(L_{fr}(b)+R_{fr}(b))/2$$

$$M_{fr}(b)=c1(b)*L_{fr}(b)+c_2*R_{fr}(b),\text{ where } c_1(b) \text{ and } c_2(b) \text{ are complex values.}$$

In some implementations, the complex values $c_1(b)$ and $c_2(b)$ are based on the stereo cues 162. For example, in one implementation of mid side down-mix when IPDs are estimated, $c_1(b)=(\cos(-\gamma)-i*\sin(-\gamma))/2^{0.5}$ and $c_2(b)=(\cos(IPD(b)-\gamma)+i*\sin(IPD(b)-\gamma))/2^{0.5}$ where i is the imaginary number signifying the square root of −1.

The frequency-domain mid-band channel 530 may be provided to a mid-band encoder 504 and to a side-band encoder 506 for the purpose of efficient side-band channel encoding. In this implementation, the mid-band encoder 504 may further transform the mid-band channel 530 to any other transform/time-domain before encoding. For example, the mid-band channel 530 ($M_{fr}(b)$) may be inverse-transformed back to time-domain, or transformed to MDCT domain for coding.

The frequency-domain mid-band channel 530 may be provided to a mid-band encoder 504 and to a side-band encoder 506 for the purpose of efficient side-band channel encoding. In this implementation, the mid-band encoder 504 may further transform the mid-band channel 530 to a transform domain or to a time-domain before encoding. For example, the mid-band channel 530 ($M_{fr}(b)$) may be inverse-transformed back to the time-domain or transformed to the MDCT domain for coding.

The side-band encoder 506 may generate the side-band bit-stream 164 based on the stereo cues 162, the frequency-domain side-band channel 334, and the frequency-domain mid-band channel 530. The mid-band encoder 504 may generate the mid-band bit-stream 166 based on the frequency-domain mid-band channel 530. For example, the mid-band encoder 504 may encode the frequency-domain mid-band channel 530 to generate the mid-band bit-stream 166.

Figure 6:
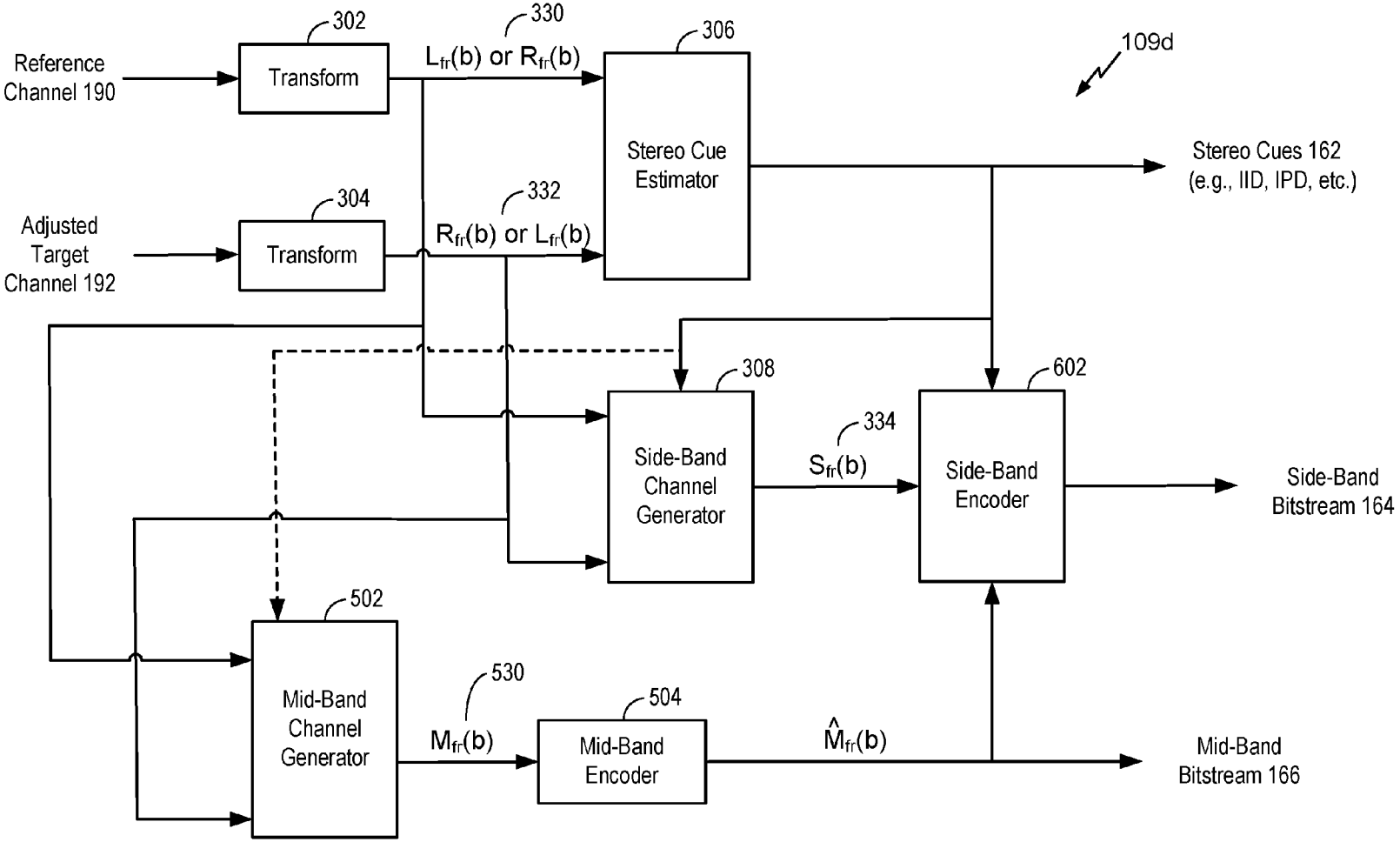
FIG. 6 is a diagram illustrating a fourth implementation of a frequency-domain stereo coder of the encoder of FIG. 1.

Referring to FIG. 6, a fourth implementation 109*d* of the signal-adaptive "flexible" stereo coder 109 is shown. The fourth implementation 109*d* of the signal-adaptive "flexible" stereo coder 109 may operate in a substantially similar manner as the third implementation 109*c* of the signal-adaptive "flexible" stereo coder 109. However, in the fourth implementation 109*d*, the mid-band bit-stream 166 may be provided to a side-band encoder 602. In an alternate implementation, the quantized mid-band channel based on the mid-band bit-stream may be provided to the side-band encoder 602. The side-band encoder 602 may be configured to generate the side-band bit-stream 164 based on the stereo cues 162, the frequency-domain side-band channel 334, and the mid-band bit-stream 166.

Figure 7:
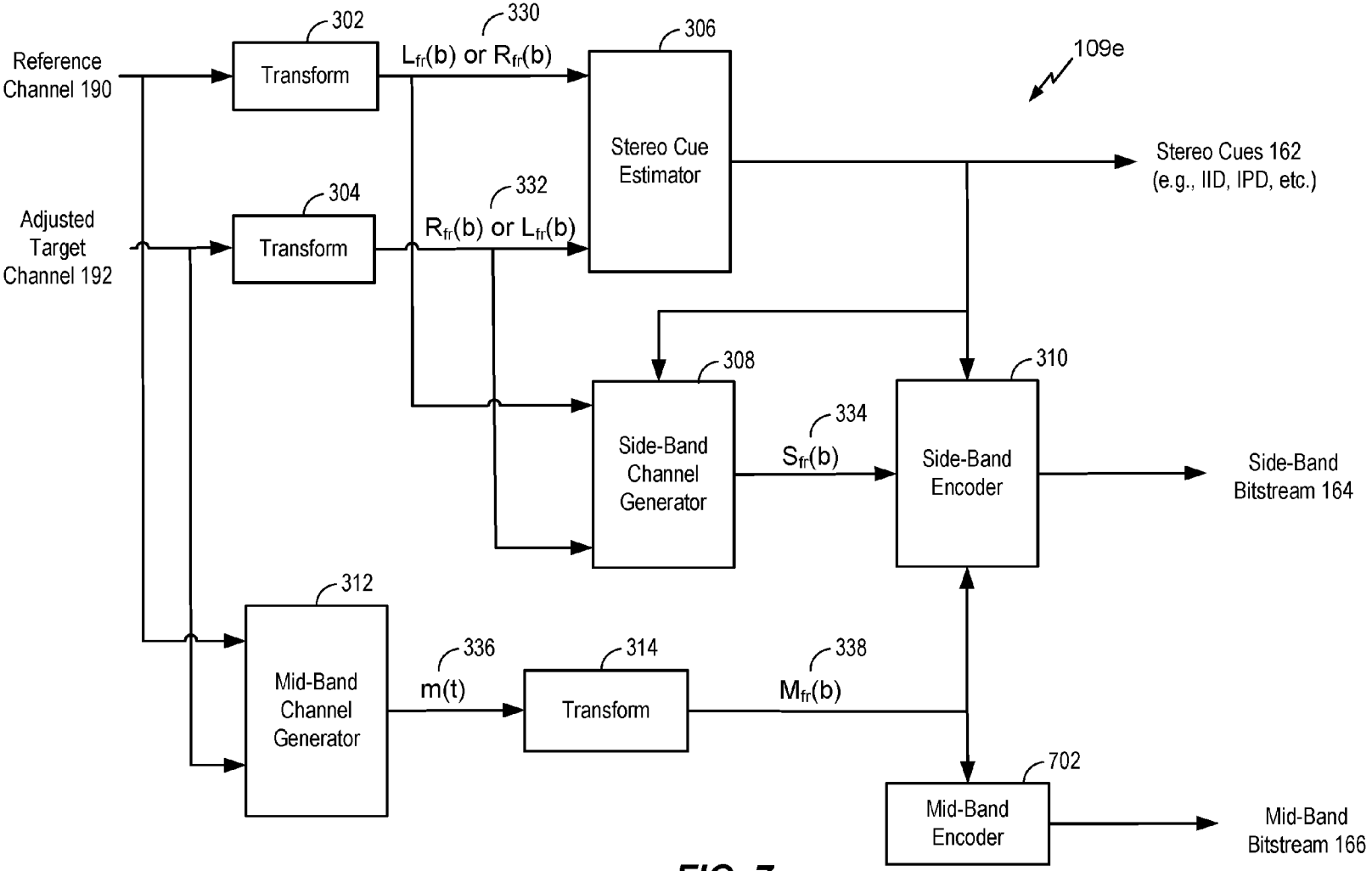
FIG. 7 is a diagram illustrating a fifth implementation of a frequency-domain stereo coder of the encoder of FIG. 1.

Referring to FIG. 7, a fifth implementation 109*e* of the signal-adaptive "flexible" stereo coder 109 is shown. The fifth implementation 109*e* of the signal-adaptive "flexible" stereo coder 109 may operate in a substantially similar manner as the first implementation 109*a* of the signal-adaptive "flexible" stereo coder 109. However, in the fifth implementation 109*e*, the frequency-domain mid-band channel 338 may be provided to a mid-band encoder 702. The mid-band encoder 702 may be configured to encode the frequency-domain mid-band channel 338 to generate the mid-band bit-stream 166.

Figure 8:
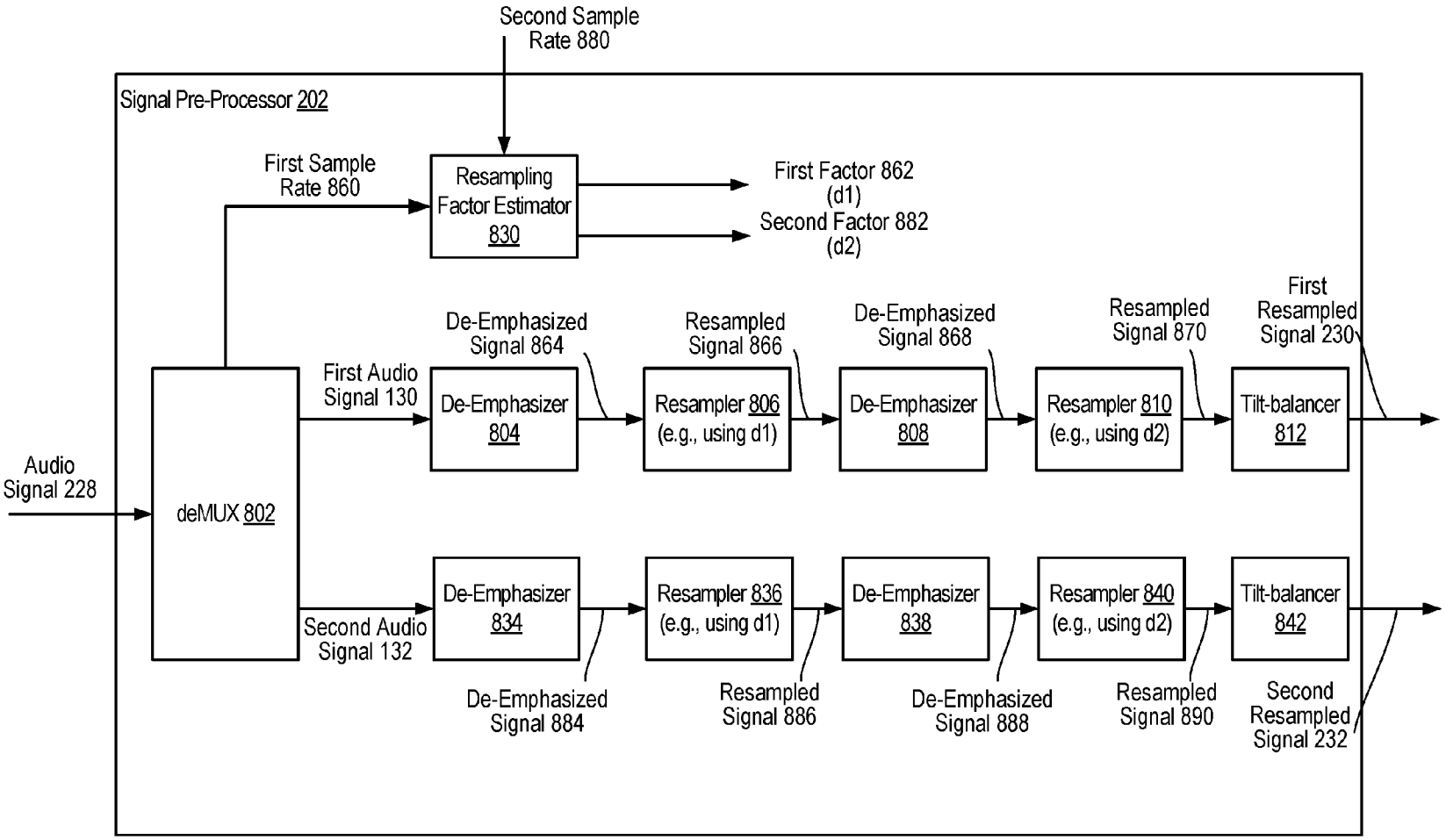
FIG. 8 is a diagram illustrating a signal pre-processor of the encoder of FIG. 1.

Referring to FIG. 8, an illustrative example of the signal pre-processor 202 is shown. The signal pre-processor 202 may include a demultiplexer (DeMUX) 802 coupled to a resampling factor estimator 830, a de-emphasizer 804, a de-emphasizer 834, or a combination thereof. The de-emphasizer 804 may be coupled to, via a resampler 806, to a de-emphasizer 808. The de-emphasizer 808 may be coupled, via a resampler 810, to a tilt-balancer 812. The de-emphasizer 834 may be coupled, via a resampler 836, to a de-emphasizer 838. The de-emphasizer 838 may be coupled, via a resampler 840, to a tilt-balancer 842.

During operation, the deMUX 802 may generate the first audio signal 130 and the second audio signal 132 by demultiplexing the audio signal 228. The deMUX 802 may provide a first sample rate 860 associated with the first audio signal 130, the second audio signal 132, or both, to the resampling factor estimator 830. The deMUX 802 may provide the first audio signal 130 to the de-emphasizer 804, the second audio signal 132 to the de-emphasizer 834, or both.

The resampling factor estimator 830 may generate a first factor 862 (d1), a second factor 882 (d2), or both, based on the first sample rate 860, a second sample rate 880, or both. The resampling factor estimator 830 may determine a resampling factor (D) based on the first sample rate 860, the second sample rate 880, or both. For example, the resampling factor (D) may correspond to a ratio of the first sample rate 860 and the second sample rate 880 (e.g., the resampling factor (D)=the second sample rate 880/the first sample rate 860 or the resampling factor (D)=the first sample rate 860/the second sample rate 880). The first factor 862 (d1), the second factor 882 (d2), or both, may be factors of the resampling factor (D). For example, the resampling factor (D) may correspond to a product of the first factor 862 (d1) and the second factor 882 (d2) (e.g., the resampling factor (D)=the first factor 862 (d1)*the second factor 882 (d2)). In some implementations, the first factor 862 (d1) may have a first value (e.g., 1), the second factor 882 (d2) may have a second value (e.g., 1), or both, which bypasses the resampling stages, as described herein.

The de-emphasizer 804 may generate a de-emphasized signal 864 by filtering the first audio signal 130 based on an IIR filter (e.g., a first order IIR filter). The de-emphasizer 804 may provide the de-emphasized signal 864 to the resampler 806. The resampler 806 may generate a resampled channel 866 by resampling the de-emphasized signal 864 based on the first factor 862 (d1). The resampler 806 may provide the resampled channel 866 to the de-emphasizer 808. The de-emphasizer 808 may generate a de-emphasized signal 868 by filtering the resampled channel 866 based on an IIR filter. The de-emphasizer 808 may provide the de-emphasized signal 868 to the resampler 810. The resampler 810 may generate a resampled channel 870 by resampling the de-emphasized signal 868 based on the second factor 882 (d2).

In some implementations, the first factor 862 (d1) may have a first value (e.g., 1), the second factor 882 (d2) may have a second value (e.g., 1), or both, which bypasses the resampling stages. For example, when the first factor 862 (d1) has the first value (e.g., 1), the resampled channel 866 may be the same as the de-emphasized signal 864. As another example, when the second factor 882 (d2) has the second value (e.g., 1), the resampled channel 870 may be the same as the de-emphasized signal 868. The resampler 810 may provide the resampled channel 870 to the tilt-balancer 812. The tilt-balancer 812 may generate the first resampled channel 230 by performing tilt balancing on the resampled channel 870.

The de-emphasizer 834 may generate a de-emphasized signal 884 by filtering the second audio signal 132 based on an IIR filter (e.g., a first order IIR filter). The de-emphasizer 834 may provide the de-emphasized signal 884 to the resampler 836. The resampler 836 may generate a resampled channel 886 by resampling the de-emphasized signal 884 based on the first factor 862 (d1). The resampler 836 may provide the resampled channel 886 to the de-emphasizer 838. The de-emphasizer 838 may generate a de-emphasized signal 888 by filtering the resampled channel 886 based on an IIR filter. The de-emphasizer 838 may provide the de-emphasized signal 888 to the resampler 840. The resampler 840 may generate a resampled channel 890 by resampling the de-emphasized signal 888 based on the second factor 882 (d2).

In some implementations, the first factor 862 (d1) may have a first value (e.g., 1), the second factor 882 (d2) may have a second value (e.g., 1), or both, which bypasses the resampling stages. For example, when the first factor 862 (d1) has the first value (e.g., 1), the resampled channel 886 may be the same as the de-emphasized signal 884. As another example, when the second factor 882 (d2) has the second value (e.g., 1), the resampled channel 890 may be the same as the de-emphasized signal 888. The resampler 840 may provide the resampled channel 890 to the tilt-balancer 842. The tilt-balancer 842 may generate the second resampled channel 532 by performing tilt balancing on the resampled channel 890. In some implementations, the tilt-balancer 812 and the tilt-balancer 842 may compensate for a low pass (LP) effect due to the de-emphasizer 804 and the de-emphasizer 834, respectively.

Figure 9:
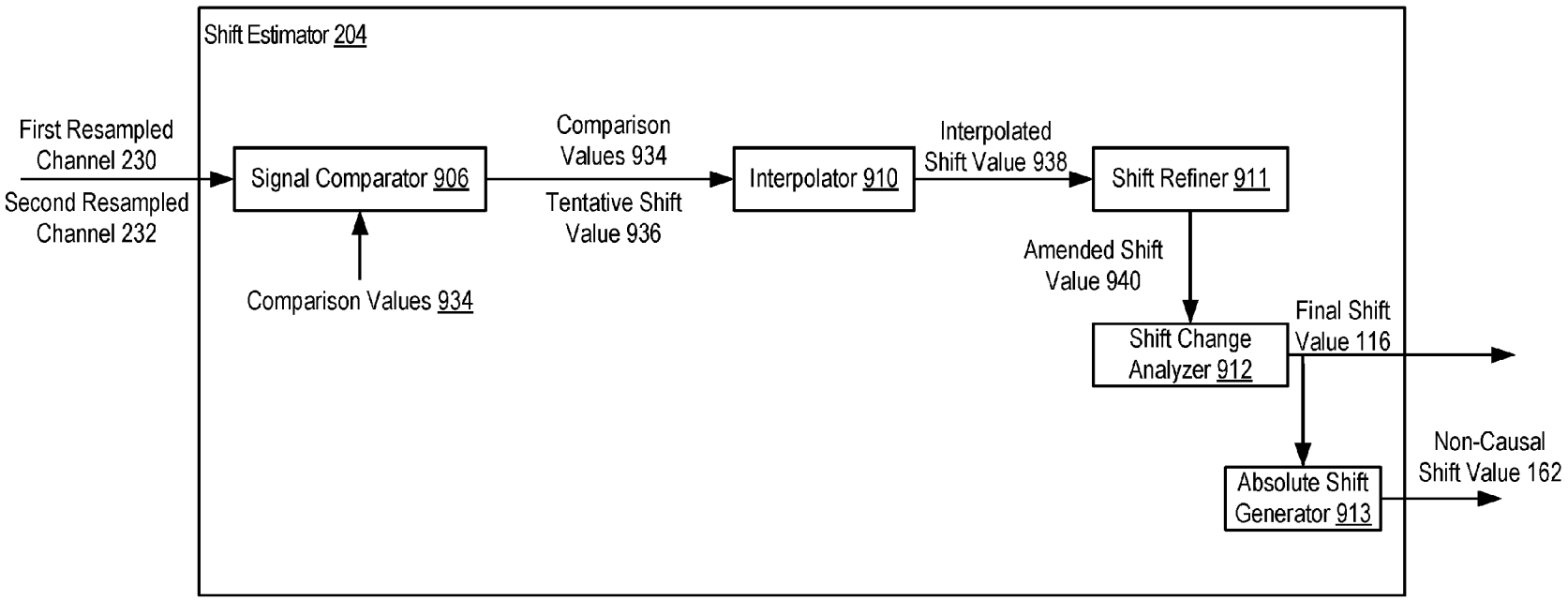
FIG. 9 is a diagram illustrating a shift estimator of the encoder of FIG. 1.

Referring to FIG. 9, an illustrative example of the shift estimator 204 is shown. The shift estimator 204 may include a signal comparator 906, an interpolator 910, a shift refiner 911, a shift change analyzer 912, an absolute shift generator 913, or a combination thereof. It should be understood that the shift estimator 204 may include fewer than or more than the components illustrated in FIG. 9.

The signal comparator 906 may generate comparison values 934 (e.g., different values, similarity values, coherence values, or cross-correlation values), a tentative shift value 936, or both. For example, the signal comparator 906 may generate the comparison values 934 based on the first resampled channel 230 and a plurality of shift values applied to the second resampled channel 232. The signal comparator 906 may determine the tentative shift value 936 based on the comparison values 934. The first resampled channel 230 may include fewer samples or more samples than the first audio signal 130. The second resampled channel 232 may include fewer samples or more samples than the second audio signal 132. Determining the comparison values 934 based on the fewer samples of the resampled channels (e.g., the first resampled channel 230 and the second resampled channel 232) may use fewer resources (e.g., time number of operations, or both) than on samples of the original signals (e.g., the first audio signal 130 and the second audio signal 132). Determining the comparison values 934 based on the more samples of the resampled channels (e.g., the first resampled channel 230 and the second resampled channel 232) may increase precision than on samples of the original signals (e.g., the first audio signal 130 and the second audio signal 132). The signal comparator 906 may provide the comparison values 934, the tentative shift value 936, or both, to the interpolator 910.

The interpolator 910 may extend the tentative shift value 936. For example, the interpolator 910 may generate an interpolated shift value 938. For example, the interpolator 910 may generate interpolated comparison values corresponding to shift values that are proximate to the tentative shift value 936 by interpolating the comparison values 934. The interpolator 910 may determine the interpolated shift value 938 based on the interpolated comparison values and the comparison values 934. The comparison values 934 may be based on a coarser granularity of the shift values. For example, the comparison values 934 may be based on a first subset of a set of shift values so that a difference between a first shift value of the first subset and each second shift value of the first subset is greater than or equal to a threshold (e.g., ≥1). The threshold may be based on the resampling factor (D).

The interpolated comparison values may be based on a finer granularity of shift values that are proximate to the resampled tentative shift value 936. For example, the interpolated comparison values may be based on a second subset of the set of shift values so that a difference between a highest shift value of the second subset and the resampled tentative shift value 936 is less than the threshold (e.g., ≥1), and a difference between a lowest shift value of the second subset and the resampled tentative shift value 936 is less than the threshold. Determining the comparison values 934 based on the coarser granularity (e.g., the first subset) of the set of shift values may use fewer resources (e.g., time, operations, or both) than determining the comparison values 934 based on a finer granularity (e.g., all) of the set of shift values. Determining the interpolated comparison values corresponding to the second subset of shift values may extend the tentative shift value 936 based on a finer granularity of a smaller set of shift values that are proximate to the tentative shift value 936 without determining comparison values corresponding to each shift value of the set of shift values. Thus, determining the tentative shift value 936 based on the first subset of shift values and determining the interpolated shift value 938 based on the interpolated comparison values may balance resource usage and refinement of the estimated shift value. The interpolator 910 may provide the interpolated shift value 938 to the shift refiner 911.

The shift refiner 911 may generate an amended shift value 940 by refining the interpolated shift value 938. For example, the shift refiner 911 may determine whether the interpolated shift value 938 indicates that a change in a shift between the first audio signal 130 and the second audio signal 132 is greater than a shift change threshold. The change in the shift may be indicated by a difference between the interpolated shift value 938 and a first shift value associated with a previous frame. The shift refiner 911 may, in response to determining that the difference is less than or equal to the threshold, set the amended shift value 940 to the interpolated shift value 938. Alternatively, the shift refiner 911 may, in response to determining that the difference is greater than the threshold, determine a plurality of shift values that correspond to a difference that is less than or equal to the shift change threshold. The shift refiner 911 may determine comparison values based on the first audio signal 130 and the plurality of shift values applied to the second audio signal 132. The shift refiner 911 may determine the amended shift value 940 based on the comparison values. For example, the shift refiner 911 may select a shift value of the plurality of shift values based on the comparison values and the interpolated shift value 938. The shift refiner 911 may set the amended shift value 940 to indicate the selected shift value. A non-zero difference between the first shift value corresponding to the previous frame and the interpolated shift value 938 may indicate that some samples of the second audio signal 132 correspond to both frames. For example, some samples of the second audio signal 132 may be duplicated during encoding. Alternatively, the non-zero difference may indicate that some samples of the second audio signal 132 correspond to neither the previous frame nor the current frame. For example, some samples of the second audio signal 132 may be lost during encoding. Setting the amended shift value 940 to one of the plurality of shift values may prevent a large change in shifts between consecutive (or adjacent) frames, thereby reducing an amount of sample loss or sample duplication during encoding. The shift refiner 911 may provide the amended shift value 940 to the shift change analyzer 912.

In some implementations, the shift refiner 911 may adjust the interpolated shift value 938. The shift refiner 911 may determine the amended shift value 940 based on the adjusted interpolated shift value 938. In some implementations, the shift refiner 911 may determine the amended shift value 940.

The shift change analyzer 912 may determine whether the amended shift value 940 indicates a switch or reverse in timing between the first audio signal 130 and the second audio signal 132, as described with reference to FIG. 1. In particular, a reverse or a switch in timing may indicate that, for the previous frame, the first audio signal 130 is received at the input interface(s) 112 prior to the second audio signal 132, and, for a subsequent frame, the second audio signal 132 is received at the input interface(s) prior to the first audio signal 130. Alternatively, a reverse or a switch in timing may indicate that, for the previous frame, the second audio signal 132 is received at the input interface(s) 112 prior to the first audio signal 130, and, for a subsequent frame, the first audio signal 130 is received at the input interface(s) prior to the second audio signal 132. In other words, a switch or reverse in timing may be indicate that a final shift value corresponding to the previous frame has a first sign that is distinct from a second sign of the amended shift value 940 corresponding to the current frame (e.g., a positive to negative transition or vice-versa). The shift change analyzer 912 may determine whether delay between the first audio signal 130 and the second audio signal 132 has switched sign based on the amended shift value 940 and the first shift value associated with the previous frame. The shift change analyzer 912 may, in response to determining that the delay between the first audio signal 130 and the second audio signal 132 has switched sign, set the final shift value 116 to a value (e.g., 0) indicating no time shift. Alternatively, the shift change analyzer 912 may set the final shift value 116 to the amended shift value 940 in response to determining that the delay between the first audio signal 130 and the second audio signal 132 has not switched sign. The shift change analyzer 912 may generate an estimated shift value by refining the amended shift value 940. The shift change analyzer 912 may set the final shift value 116 to the estimated shift value. Setting the final shift value 116 to indicate no time shift may reduce distortion at a decoder by refraining from time shifting the first audio signal 130 and the second audio signal 132 in opposite directions for consecutive (or adjacent) frames of the first audio signal 130. The absolute shift generator 913 may generate the non-causal shift value 162 by applying an absolute function to the final shift value 116.

Figure 10:
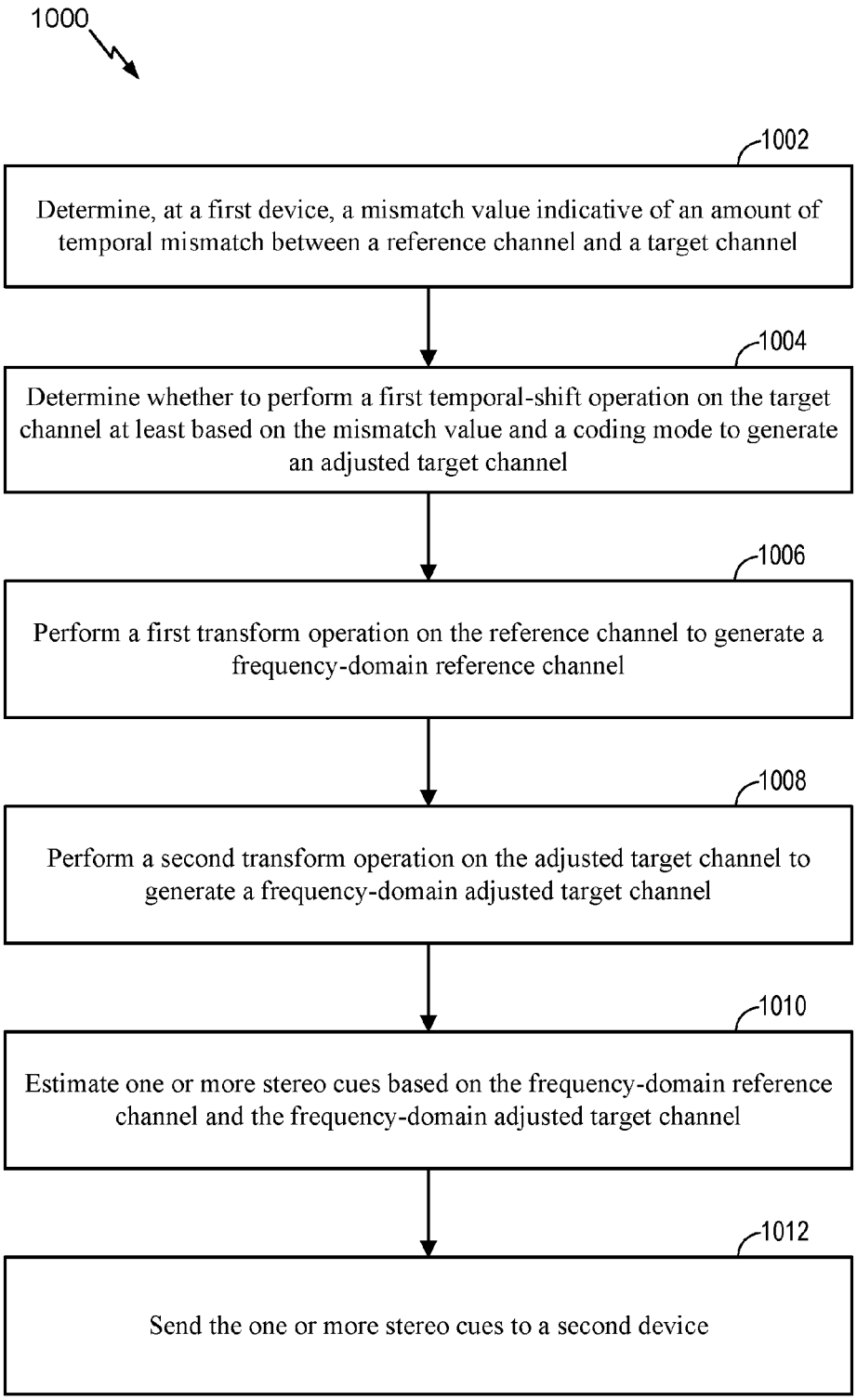
FIG. 10 is a flow chart illustrating a particular method of encoding multiple audio signals.

Referring to FIG. 10, a method 1000 of communication is shown. The method 1000 may be performed by the first device 104 of FIG. 1, the encoder 114 of FIGS. 1-2, signal-adaptive "flexible" stereo coder 109 of FIG. 1-7, the signal pre-processor 202 of FIGS. 2 and 8, the shift estimator 204 of FIGS. 2 and 9, or a combination thereof.

The method 1000 includes determining, at a first device, a mismatch value indicative of an amount of temporal mismatch between a reference channel and a target channel, at 1002. For example, referring to FIG. 2, the temporal equalizer 108 may determine the mismatch value (e.g., the final shift value 116) indicative of the amount of temporal mismatch between the first audio signal 130 and the second audio signal 132. A first value (e.g., a positive value) of the final shift value 116 may indicate that the second audio signal 132 is delayed relative to the first audio signal 130. A second value (e.g., a negative value) of the final shift value 116 may indicate that the first audio signal 130 is delayed relative to the second audio signal 132. A third value (e.g., 0) of the final shift value 116 may indicate no delay between the first audio signal 130 and the second audio signal 132.

The method 1000 includes determining whether to perform a first temporal-shift operation on the target channel at least based on the mismatch value and a coding mode to generate an adjusted target channel, at 1004. For example, referring to FIG. 2, the target channel adjuster 210 may determine whether to adjust the target channel 242 and may adjust the target channel 242 based on a temporal shift evolution from the first shift value 262 (Tprev) to the final shift value 116 (T). For example, the first shift value 262 may include a final shift value corresponding to the previous frame. The target channel adjuster 210 may, in response to determining that a final shift value changed from the first shift value 262 having a first value (e.g., Tprev=2) corresponding to the previous frame that is lower than the final shift value 116 (e.g., T=4) corresponding to the previous frame, interpolate the target channel 242 such that a subset of samples of the target channel 242 that correspond to frame boundaries are dropped through smoothing and slow-shifting to generate the adjusted target channel 192. Alternatively, the target channel adjuster 210 may, in response to determining that a final shift value changed from the first shift value 262 (e.g., Tprev=4) that is greater than the final shift value 116 (e.g., T=2), interpolate the target channel 242 such that a subset of samples of the target channel 242 that correspond to frame boundaries are repeated through smoothing and slow-shifting to generate the adjusted target channel 192. The smoothing and slow-shifting may be performed based on hybrid Sinc- and Lagrange-interpolators. The target channel adjuster 210 may, in response to determining that a final shift value is unchanged from the first shift value 262 to the final shift value 116 (e.g., Tprev=T), temporally offset the target channel 242 to generate the adjusted target channel 192.

A first transform operation may be performed on the reference channel to generate a frequency-domain reference channel, at 1006. A second transform operation may be performed on the adjusted target channel to generate a frequency-domain adjusted target channel, at 1008. For example, referring to FIGS. 3-7, the transform 302 may be performed on the reference channel 190 and the transform 304 may be performed on the adjusted target channel 192. The transforms 302, 304 may include frequency-domain transform operations. As non-limiting examples, the transforms 302, 304 may include DFT operations, FFT operations, etc. According to some implementations, QMF operations (e.g., using complex low delay filter banks) may be used to split the input signals (e.g., the reference channel 190 and the adjusted target channel 192) into multiple sub-bands, and in some implementations, the sub-bands may be further converted into the frequency-domain using another frequency-domain transform operation. The transform 302 may be applied to the reference channel 190 to generate a frequency-domain reference channel $L_{fr}(b)$ 330, and the transform 304 may be applied to the adjusted target channel 192 to generate a frequency-domain adjusted target channel $R_{fr}(b)$ 332.

One or more stereo cues may be estimated based on the frequency-domain reference channel and the frequency-domain adjusted target channel, at 1010. For example, referring to FIGS. 3-7, the frequency-domain reference channel 330 and the frequency-domain adjusted target channel 332 may be provided to a stereo cue estimator 306 and to a side-band channel generator 308. The stereo cue estimator 306 may extract (e.g., generate) the stereo cues 162 based on the frequency-domain reference channel 330 and the frequency-domain adjusted target channel 332. To illustrate, the IID(b) may be a function of the energies $E_L(b)$ of the left channels in the band (b) and the energies $E_R(b)$ of the right channels in the band (b). For example, IID(b) may be expressed as $20*\log_{10}(E_L(b)/E_R(b))$. IPDs estimated and transmitted at the encoder may provide an estimate of the phase difference in the frequency-domain between the left and right channels in the band (b). The stereo cues 162 may include additional (or alternative) parameters, such as ICCs, ITDs etc.

The one or more stereo cues may be sent to a second device, at 1012. For example, referring to FIG. 1, first device 104 may transmit the stereo cues 162 to the second device 106 of FIG. 1.

The method 1000 may also include generating a time-domain mid-band channel based on the reference channel and the adjusted target channel. For example, referring to FIGS. 3, 4, and 7, the mid-band channel generator 312 may generate the time-domain mid-band channel 336 based on the reference channel 190 and the adjusted target channel 192. For example, the time-domain mid-band channel 336 may be expressed as (l(t)+r(t))/2, where l(t) includes the reference channel 190 and r(t) includes the adjusted target channel 192. The method 1000 may also include encoding the time-domain mid-band channel to generate a mid-band bit-stream. For example, referring to FIGS. 3 and 4, the mid-band encoder 316 may generate the mid-band bit-stream 166 by encoding the time-domain mid-band channel 336. The method 1000 may further include sending the mid-band bit-stream to the second device. For example, referring to FIG. 1, the transmitter 110 may send the mid-band bit-stream 166 to the second device 106.

The method 1000 may also include generating a side-band channel based on the frequency-domain reference channel, the frequency-domain adjusted target channel, and the one or more stereo cues. For example, referring to FIG. 3, the side-band generator 308 may generate the frequency-domain side-band channel 334 based on the frequency-domain reference channel 330 and the frequency-domain adjusted target channel 332. The frequency-domain side-band channel 334 may be estimated in the frequency-domain bins/bands. In each band, the gain parameter (g) is different and may be based on the interchannel level differences (e.g., based on the stereo cues 162). For example, the frequency-domain side-band channel 334 may be expressed as $(L_{fr}(b)-c(b)*R_{fr}(b))/(1+c(b))$, where c(b) may be the ILD(b) or a function of the ILD(b) (e.g., c(b)=10^(ILD(b)/20)).

The method 1000 may also include performing a third transform operation on the time-domain mid-band channel to generate a frequency-domain mid-band channel. For example, referring to FIG. 3, the transform 314 may be applied to the time-domain mid-band channel 336 to generate the frequency-domain mid-band channel 338. The method 1000 may also include generating a side-band bit-stream based on the side-band channel, the frequency-domain mid-band channel, and the one or more stereo cues. For example, referring to FIG. 3, the side-band encoder 310 may generate the side-band bit-stream 164 based on the stereo cues 162, the frequency-domain side-band channel 334, and the frequency-domain mid-band channel 338.

The method 1000 may also include generating a frequency-domain mid-band channel based on the frequency-domain reference channel and the frequency-domain adjusted target channel and additionally or alternatively based on the stereo cues. For example, referring to FIGS. 5-6, the mid-band channel generator 502 may generate the frequency-domain mid-band channel 530 based on the frequency-domain reference channel 330 and the frequency-domain adjusted target channel 332 and additionally or alternatively based on the stereo cues 162. The method 1000 may also include encoding the frequency-domain mid-band channel to generate a mid-band bit-stream. For example, referring to FIG. 5, the mid-band encoder 504 may encode the frequency-domain mid-band channel 530 to generate the mid-band bit-stream 166.

The method 1000 may also include generating a side-band channel based on the frequency-domain reference channel, the frequency-domain adjusted target channel, and the one or more stereo cues. For example, referring to FIGS. 5-6, the side-band generator 308 may generate the frequency-domain side-band channel 334 based on the frequency-domain reference channel 330 and the frequency-domain adjusted target channel 332. According to one implementation, the method 1000 includes generating a side-band bit-stream based on the side-band channel, the mid-band bit-stream, and the one or more stereo cues. For example, referring to FIG. 6, the mid-band bit-stream 166 may be provided to the side-band encoder 602. The side-band encoder 602 may be configured to generate the side-band bit-stream 164 based on the stereo cues 162, the frequency-domain side-band channel 334, and the mid-band bit-stream 166. According to another implementation, the method 1000 includes generating a side-band bit-stream based on the side-band channel, the frequency-domain mid-band channel, and the one or more stereo cues. For example, referring to FIG. 5, the side-band encoder 506 may generate the side-band bit-stream 164 based on the stereo cues 162, the frequency-domain side-band channel 334, and the frequency-domain mid-band channel 530.

According to one implementation, the method 1000 may also include generating a first down-sampled channel by down-sampling the reference channel and generating a second down-sampled channel by down-sampling the target channel. The method 1000 may also include determining comparison values based on the first down-sampled channel and a plurality of shift values applied to the second down-sampled channel. The shift value may be based on the comparison values.

The method 1000 of FIG. 10 may enable the signal-adaptive "flexible" stereo coder 109 to transform the reference channel 190 and the adjusted target channel 192 into the frequency-domain to generate the stereo cues 162, the side-band bit-stream 164, and the mid-band bit-stream 166. The time-shifting techniques of the temporal equalizer 108 that temporally shift the first audio signal 130 to align with the second audio signal 132 may be implemented in conjunction with frequency-domain signal processing. To illustrate, temporal equalizer 108 estimates a shift (e.g., a non-casual shift value) for each frame at the encoder 114, shifts (e.g., adjusts) a target channel according to the non-casual shift value, and uses the shift adjusted channels for the stereo cues estimation in the transform-domain.

Figure 11:
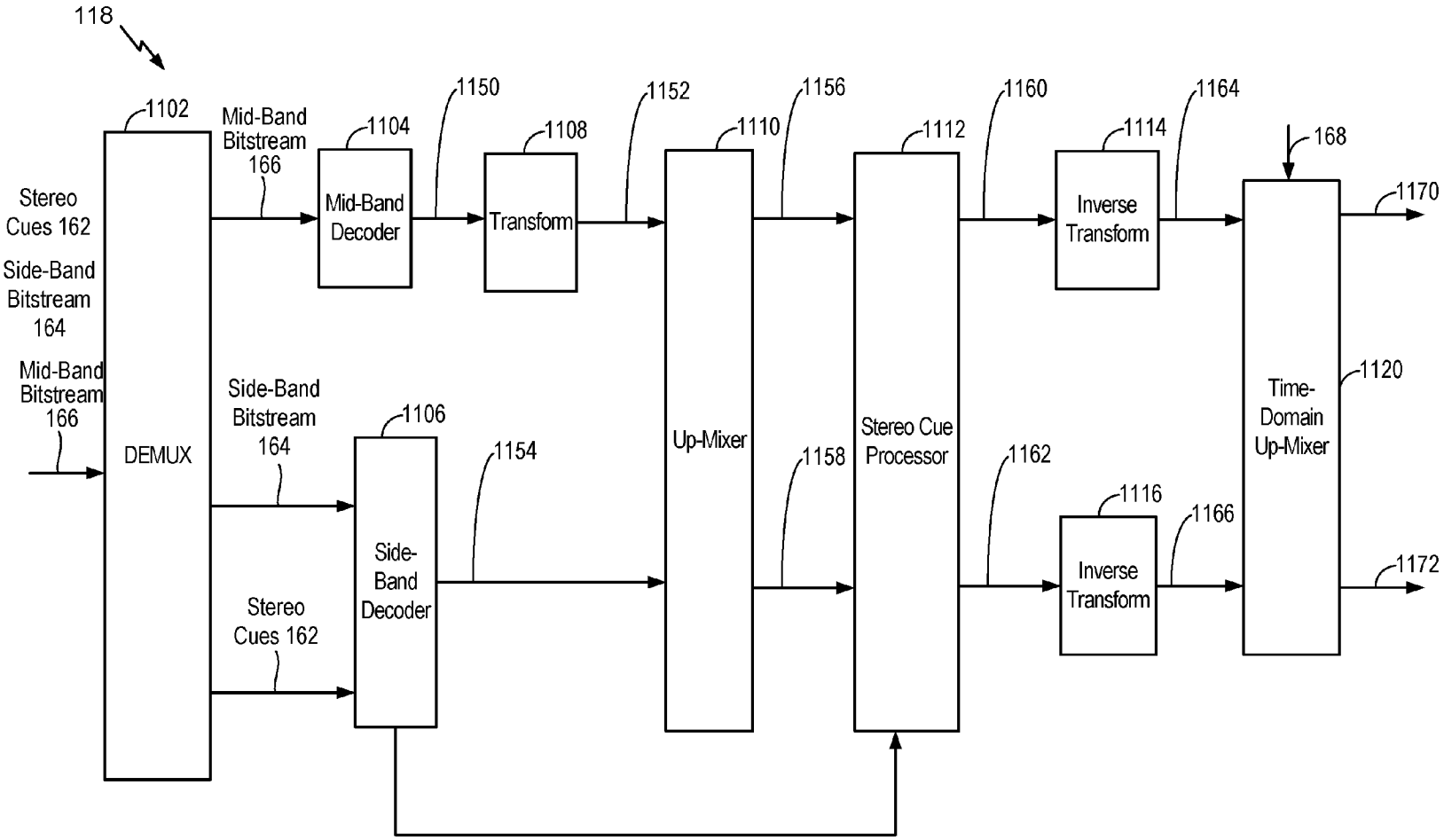
FIG. 11 is a diagram illustrating a decoder operable to decode audio signals.

Referring to FIG. 11, a diagram illustrating a particular implementation of the decoder 118 is shown. An encoded audio signal is provided to a demultiplexer (DEMUX) 1102 of the decoder 118. The encoded audio signal may include the stereo cues 162, the side-band bit-stream 164, and the mid-band bit-stream 166. The demultiplexer 1102 may be configured to extract the mid-band bit-stream 166 from the encoded audio signal and provide the mid-band bit-stream 166 to a mid-band decoder 1104. The demultiplexer 1102 may also be configured to extract the side-band bit-stream 164 and the stereo cues 162 from the encoded audio signal. The side-band bit-stream 164 and the stereo cues 162 may be provided to a side-band decoder 1106.

The mid-band decoder 1104 may be configured to decode the mid-band bit-stream 166 to generate a mid-band channel ($m_{CODED}(t)$) 1150. If the mid-band channel 1150 is a time-domain signal, a transform 1108 may be applied to the mid-band channel 1150 to generate a frequency-domain mid-band channel ($M_{CODED}(b)$) 1152. The frequency-domain mid-band channel 1152 may be provided to an up-mixer 1110. However, if the mid-band channel 1150 is a frequency-domain signal, the mid-band channel 1150 may be provided directly to the up-mixer 1110 and the transform 1108 may be bypassed or may not be present in the decoder 118.

The side-band decoder 1106 may generate a side-band channel ($S_{CODED}(b)$) 1154 based on the side-band bit-stream 164 and the stereo cues 162. For example, the error (e) may be decoded for the low-bands and the high-bands. The side-band channel 1154 may be expressed as $S_{PRED}(b)+e_{CODED}(b)$, where $S_{PRED}(b)=M_{CODED}(b)*(ILD(b)-1)/(ILD(b)+1)$. The side-band channel 1154 may also be provided to the up-mixer 1110.

The up-mixer 1110 may perform an up-mix operation based on the frequency-domain mid-band channel 1152 and the side-band channel 1154. For example, the up-mixer 1110 may generate a first up-mixed signal ($L_{fr}$) 1156 and a second up-mixed signal ($R_{fr}$) 1158 based on the frequency-domain mid-band channel 1152 and the side-band channel 1154. Thus, in the described example, the first up-mixed signal 1156 may be a left-channel signal, and the second up-mixed signal 1158 may be a right-channel signal. The first up-mixed signal 1156 may be expressed as $M_{CODED}(b)+S_{CODED}(b)$, and the second up-mixed signal 1158 may be expressed as $M_{CODED}(b)-S_{CODED}(b)$. The up-mixed signals 1156, 1158 may be provided to a stereo cue processor 1112.

The stereo cue processor 1112 may apply the stereo cues 162 to the up-mixed signals 1156, 1158 to generate signals 1160, 1162. For example, the stereo cues 162 may be applied to the up-mixed left and right channels in the frequency-domain. When available, the IPD (phase differences) may be spread on the left and right channels to maintain the inter-channel phase differences. An inverse transform 1114 may be applied to the signal 1160 to generate a first time-domain signal l(t) 1164, and an inverse transform 1116 may be applied to the signal 1162 to generate a second time-domain signal r(t) 1166. Non-limiting examples of the inverse transforms 1114, 1116 include Inverse Discrete Cosine Transform (IDCT) operations, Inverse Fast Fourier Transform (IFFT) operations, etc. According to one implementation, the first time-domain signal 1164 may be a reconstructed version of the reference channel 190, and the second time-domain signal 1166 may be a reconstructed version of the adjusted target channel 192.

According to one implementation, the operations performed at the up-mixer 1110 may be performed at the stereo cue processor 1112. According to another implementation, the operations performed at the stereo cue processor 1112 may be performed at the up-mixer 1110. According to yet another implementation, the up-mixer 1110 and the stereo cue processor 1112 may be implemented within a single processing element (e.g., a single processor).

Additionally, the first time-domain signal 1164 and the second time-domain signal 1166 may be provided to a time-domain up-mixer 1120. The time-domain up-mixer 1120 may perform a time-domain up-mix on the time-domain signals 1164, 1166 (e.g., the inverse-transformed left and right signals). The time-domain up-mixer 1120 may perform a reverse shift adjustment to undo the shift adjustment performed in the temporal equalizer 108 (more specifically the target channel adjuster 210). The time-domain up-mix may be based on the time-domain down-mix parameters 168. For example, the time-domain up-mix may be based on the first shift value 262 and the reference channel indicator 264. Additionally, the time-domain up-mixer 1120 may perform inverse operations of other operations performed at a time-domain down-mix module which may be present.

Figure 12:
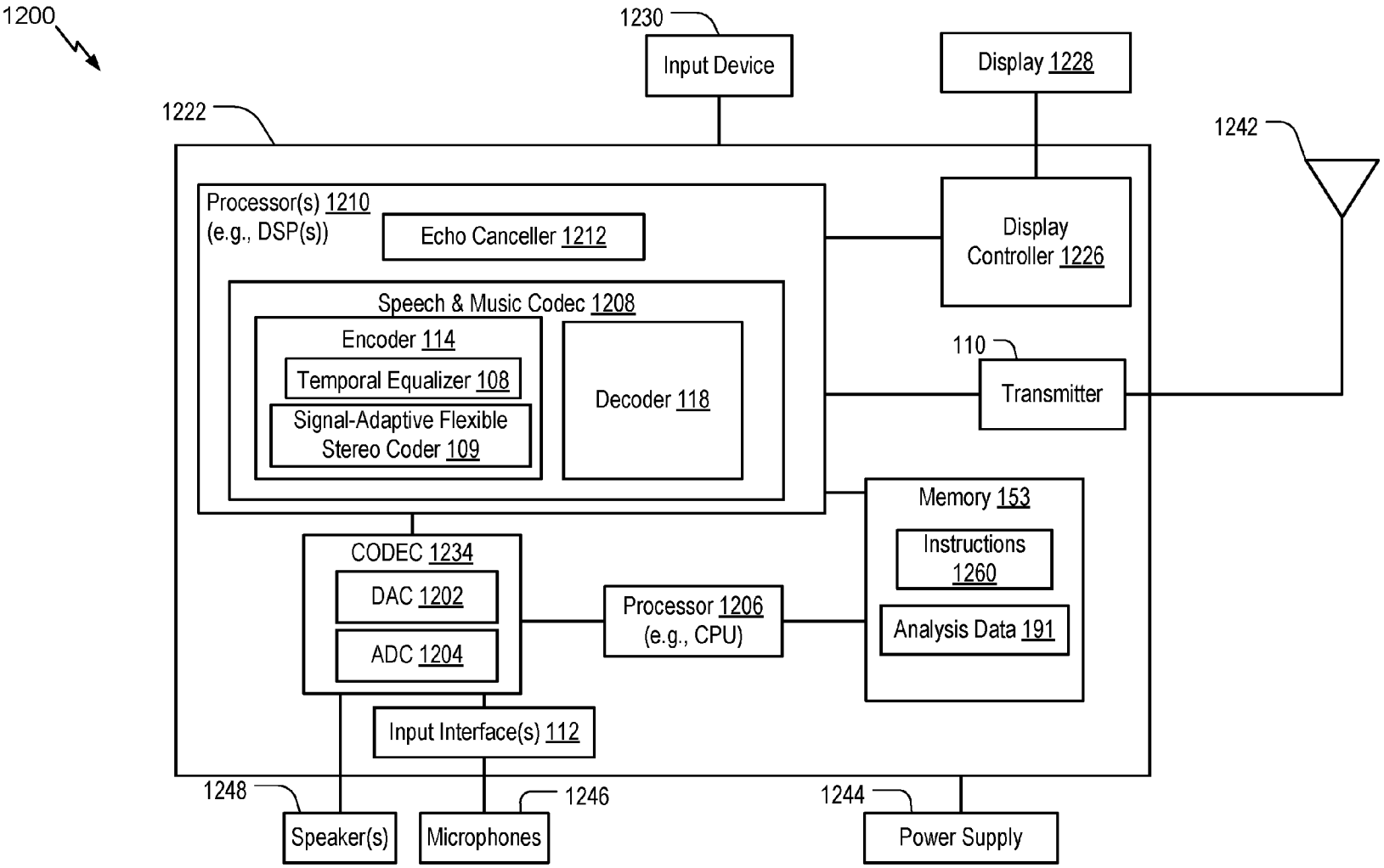
FIG. 12 is a block diagram of a particular illustrative example of a device that is operable to encode multiple audio signals.

Referring to FIG. 12, a block diagram of a particular illustrative example of a device (e.g., a wireless communication device) is depicted and generally designated 1200. In various embodiments, the device 1200 may have fewer or more components than illustrated in FIG. 12. In an illustrative embodiment, the device 1200 may correspond to the first device 104 or the second device 106 of FIG. 1. In an illustrative embodiment, the device 1200 may perform one or more operations described with reference to systems and methods of FIGS. 1-11.

In a particular embodiment, the device 1200 includes a processor 1206 (e.g., a central processing unit (CPU)). The device 1200 may include one or more additional processors 1210 (e.g., one or more digital signal processors (DSPs)). The processors 1210 may include a media (e.g., speech and music) coder-decoder (CODEC) 1208, and an echo canceller 1212. The media CODEC 1208 may include the decoder 118, the encoder 114, or both, of FIG. 1. The encoder 114 may include the temporal equalizer 108.

The device 1200 may include a memory 153 and a CODEC 1234. Although the media CODEC 1208 is illustrated as a component of the processors 1210 (e.g., dedicated circuitry and/or executable programming code), in other embodiments one or more components of the media CODEC 1208, such as the decoder 118, the encoder 114, or both, may be included in the processor 1206, the CODEC 1234, another processing component, or a combination thereof.

The device 1200 may include the transmitter 110 coupled to an antenna 1242. The device 1200 may include a display 1228 coupled to a display controller 1226. One or more speakers 1248 may be coupled to the CODEC 1234. One or more microphones 1246 may be coupled, via the input interface(s) 112, to the CODEC 1234. In a particular implementation, the speakers 1248 may include the first loudspeaker 142, the second loudspeaker 144 of FIG. 1, or a combination thereof. In a particular implementation, the microphones 1246 may include the first microphone 146, the second microphone 148 of FIG. 1, or a combination thereof. The CODEC 1234 may include a digital-to-analog converter (DAC) 1202 and an analog-to-digital converter (ADC) 1204.

The memory 153 may include instructions 1260 executable by the processor 1206, the processors 1210, the CODEC 1234, another processing unit of the device 1200, or a combination thereof, to perform one or more operations described with reference to FIGS. 1-11. The memory 153 may store the analysis data 191.

One or more components of the device 1200 may be implemented via dedicated hardware (e.g., circuitry), by a processor executing instructions to perform one or more tasks, or a combination thereof. As an example, the memory 153 or one or more components of the processor 1206, the processors 1210, and/or the CODEC 1234 may be a memory device, such as a random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). The memory device may include instructions (e.g., the instructions 1260) that, when executed by a computer (e.g., a processor in the CODEC 1234, the processor 1206, and/or the processors 1210), may cause the computer to perform one or more operations described with reference to FIGS. 1-11. As an example, the memory 153 or the one or more components of the processor 1206, the processors 1210, and/or the CODEC 1234 may be a non-transitory computer-readable medium that includes instructions (e.g., the instructions 1260) that, when executed by a computer (e.g., a processor in the CODEC 1234, the processor 1206, and/or the processors 1210), cause the computer perform one or more operations described with reference to FIGS. 1-11.

In a particular embodiment, the device 1200 may be included in a system-in-package or system-on-chip device (e.g., a mobile station modem (MSM)) 1222. In a particular embodiment, the processor 1206, the processors 1210, the display controller 1226, the memory 153, the CODEC 1234, and the transmitter 110 are included in a system-in-package or the system-on-chip device 1222. In a particular embodiment, an input device 1230, such as a touchscreen and/or keypad, and a power supply 1244 are coupled to the system-on-chip device 1222. Moreover, in a particular embodiment, as illustrated in FIG. 12, the display 1228, the input device 1230, the speakers 1248, the microphones 1246, the antenna 1242, and the power supply 1244 are external to the system-on-chip device 1222. However, each of the display 1228, the input device 1230, the speakers 1248, the microphones 1246, the antenna 1242, and the power supply 1244 can be coupled to a component of the system-on-chip device 1222, such as an interface or a controller.

The device 1200 may include a wireless telephone, a mobile communication device, a mobile phone, a smart phone, a cellular phone, a laptop computer, a desktop computer, a computer, a tablet computer, a set top box, a personal digital assistant (PDA), a display device, a television, a gaming console, a music player, a radio, a video player, an entertainment unit, a communication device, a fixed location data unit, a personal media player, a digital video player, a digital video disc (DVD) player, a tuner, a camera, a navigation device, a decoder system, an encoder system, or any combination thereof.

In a particular implementation, one or more components of the systems and devices disclosed herein may be integrated into a decoding system or apparatus (e.g., an electronic device, a CODEC, or a processor therein), into an encoding system or apparatus, or both. In other implementations, one or more components of the systems and devices disclosed herein may be integrated into a wireless telephone, a tablet computer, a desktop computer, a laptop computer, a set top box, a music player, a video player, an entertainment unit, a television, a game console, a navigation device, a communication device, a personal digital assistant (PDA), a fixed location data unit, a personal media player, or another type of device.

It should be noted that various functions performed by the one or more components of the systems and devices disclosed herein are described as being performed by certain components or modules. This division of components and modules is for illustration only. In an alternate implementation, a function performed by a particular component or module may be divided amongst multiple components or modules. Moreover, in an alternate implementation, two or more components or modules may be integrated into a single component or module. Each component or module may be implemented using hardware (e.g., a field-programmable gate array (FPGA) device, an application-specific integrated circuit (ASIC), a DSP, a controller, etc.), software (e.g., instructions executable by a processor), or any combination thereof.

In conjunction with the described implementations, an apparatus includes means for determining a mismatch value indicative of an amount of temporal mismatch between a reference channel and a target channel. For example, the means for determining may include the temporal equalizer 108, the encoder 114, the first device 104 of FIG. 1, the media CODEC 1208, the processors 1210, the device 1200, one or more devices configured to determine the mismatch value (e.g., a processor executing instructions that are stored at a computer-readable storage device), or a combination thereof.

The apparatus may also include means for performing a time-shift operation on the target channel based on the mismatch value to generate an adjusted target channel. For example, the means for performing the time-shift operation may include the temporal equalizer 108, the encoder 114 of FIG. 1, the target channel adjuster 210 of FIG. 2, the media CODEC 1208, the processors 1210, the device 1200, one or more devices configured to perform a time-shift operation (e.g., a processor executing instructions that are stored at a computer-readable storage device), or a combination thereof.

The apparatus may also include means for performing a first transform operation on the reference channel to generate a frequency-domain reference channel. For example, the means for performing the first transform operation may include the signal-adaptive "flexible" stereo coder 109, the encoder 114 of FIG. 1, the transform 302 of FIGS. 3-7, the media CODEC 1208, the processors 1210, the device 1200, one or more devices configured to perform a transform operation (e.g., a processor executing instructions that are stored at a computer-readable storage device), or a combination thereof.

The apparatus may also include means for performing a second transform operation on the adjusted target channel to generate a frequency-domain adjusted target channel. For example, the means for performing the second transform operation may include the signal-adaptive "flexible" stereo coder 109, the encoder 114 of FIG. 1, the transform 304 of FIGS. 3-7, the media CODEC 1208, the processors 1210, the device 1200, one or more devices configured to perform a transform operation (e.g., a processor executing instructions that are stored at a computer-readable storage device), or a combination thereof.

The apparatus may also include means for estimating one or more stereo cues based on the frequency-domain reference channel and the frequency-domain adjusted target channel. For example, the means for estimating may include the signal-adaptive "flexible" stereo coder 109, the encoder 114 of FIG. 1, the stereo cue estimator 306 of FIGS. 3-7, the media CODEC 1208, the processors 1210, the device 1200, one or more devices configured to estimate stereo cues (e.g., a processor executing instructions that are stored at a computer-readable storage device), or a combination thereof.

The apparatus may also include means for sending the one or more stereo cues. For example, the means for sending may include the transmitter 110 of FIGS. 1 and 12, the antenna 1242 of FIG. 12, or both.

Figure 13:
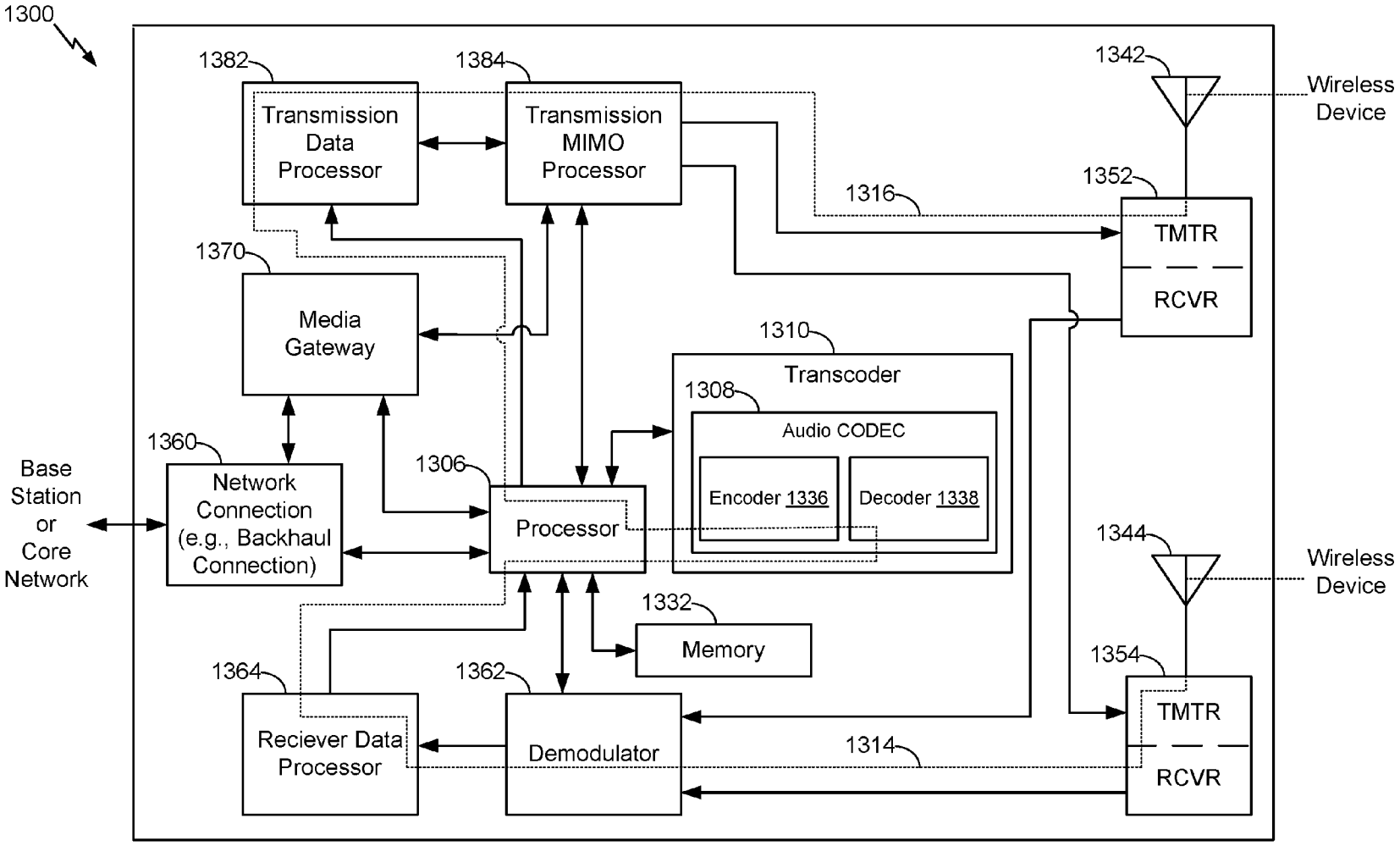
FIG. 13 is a block diagram of a base station that is operable to encode multiple audio signals.

Referring to FIG. 13, a block diagram of a particular illustrative example of a base station 1300 is depicted. In various implementations, the base station 1300 may have more components or fewer components than illustrated in FIG. 13. In an illustrative example, the base station 1300 may include the first device 104 or the second device 106 of FIG. 1. In an illustrative example, the base station 1300 may operate according to one or more of the methods or systems described with reference to FIGS. 1-12.

The base station 1300 may be part of a wireless communication system. The wireless communication system may include multiple base stations and multiple wireless devices. The wireless communication system may be a Long Term Evolution (LTE) system, a Code Division Multiple Access (CDMA) system, a Global System for Mobile Communications (GSM) system, a wireless local area network (WLAN) system, or some other wireless system. A CDMA system may implement Wideband CDMA (WCDMA), CDMA 1×, Evolution-Data Optimized (EVDO), Time Division Synchronous CDMA (TD-SCDMA), or some other version of CDMA.

The wireless devices may also be referred to as user equipment (UE), a mobile station, a terminal, an access terminal, a subscriber unit, a station, etc. The wireless devices may include a cellular phone, a smartphone, a tablet, a wireless modem, a personal digital assistant (PDA), a handheld device, a laptop computer, a smartbook, a netbook, a tablet, a cordless phone, a wireless local loop (WLL) station, a Bluetooth device, etc. The wireless devices may include or correspond to the device 1200 of FIG. 12.

Various functions may be performed by one or more components of the base station 1300 (and/or in other components not shown), such as sending and receiving messages and data (e.g., audio data). In a particular example, the base station 1300 includes a processor 1306 (e.g., a CPU). The base station 1300 may include a transcoder 1310. The transcoder 1310 may include an audio CODEC 1308. For example, the transcoder 1310 may include one or more components (e.g., circuitry) configured to perform operations of the audio CODEC 1308. As another example, the transcoder 1310 may be configured to execute one or more computer-readable instructions to perform the operations of the audio CODEC 1308. Although the audio CODEC 1308 is illustrated as a component of the transcoder 1310, in other examples one or more components of the audio CODEC 1308 may be included in the processor 1306, another processing component, or a combination thereof. For example, a decoder 1338 (e.g., a vocoder decoder) may be included in a receiver data processor 1364. As another example, an encoder 1336 (e.g., a vocoder encoder) may be included in a transmission data processor 1382. The encoder 1336 may include the encoder 114 of FIG. 1. The decoder 1338 may include the decoder 118 of FIG. 1.

The transcoder 1310 may function to transcode messages and data between two or more networks. The transcoder 1310 may be configured to convert message and audio data from a first format (e.g., a digital format) to a second format. To illustrate, the decoder 1338 may decode encoded signals having a first format and the encoder 1336 may encode the decoded signals into encoded signals having a second format. Additionally or alternatively, the transcoder 1310 may be configured to perform data rate adaptation. For example, the transcoder 1310 may down-convert a data rate or up-convert the data rate without changing a format the audio data. To illustrate, the transcoder 1310 may down-convert 64 kbit/s signals into 16 kbit/s signals.

The base station 1300 may include a memory 1332. The memory 1332, such as a computer-readable storage device, may include instructions. The instructions may include one or more instructions that are executable by the processor 1306, the transcoder 1310, or a combination thereof, to perform one or more operations described with reference to the methods and systems of FIGS. 1-12. For example, the operations may include determining a mismatch value indicative of an amount of temporal mismatch between a reference channel and a target channel. The operations may also include performing a time-shift operation on the target channel based on the mismatch value to generate an adjusted target channel. The operations may also include performing a first transform operation on the reference channel to generate a frequency-domain reference channel and performing a second transform operation on the adjusted target channel to generate a frequency-domain adjusted target channel. The operations may further include estimating one or more stereo cues based on the frequency-domain reference channel and the frequency-domain adjusted target channel. The operations may also include initiating transmission of the one or more stereo cues to a receiver.

The base station 1300 may include multiple transmitters and receivers (e.g., transceivers), such as a first transceiver 1352 and a second transceiver 1354, coupled to an array of antennas. The array of antennas may include a first antenna 1342 and a second antenna 1344. The array of antennas may be configured to wirelessly communicate with one or more wireless devices, such as the device 1200 of FIG. 12. For example, the second antenna 1344 may receive a data stream 1314 (e.g., a bit stream) from a wireless device. The data stream 1314 may include messages, data (e.g., encoded speech data), or a combination thereof.

The base station 1300 may include a network connection 1360, such as backhaul connection. The network connection 1360 may be configured to communicate with a core network or one or more base stations of the wireless communication network. For example, the base station 1300 may receive a second data stream (e.g., messages or audio data) from a core network via the network connection 1360. The base station 1300 may process the second data stream to generate messages or audio data and provide the messages or the audio data to one or more wireless device via one or more antennas of the array of antennas or to another base station via the network connection 1360. In a particular implementation, the network connection 1360 may be a wide area network (WAN) connection, as an illustrative, non-limiting example. In some implementations, the core network may include or correspond to a Public Switched Telephone Network (PSTN), a packet backbone network, or both.

The base station 1300 may include a media gateway 1370 that is coupled to the network connection 1360 and the processor 1306. The media gateway 1370 may be configured to convert between media streams of different telecommunications technologies. For example, the media gateway 1370 may convert between different transmission protocols, different coding schemes, or both. To illustrate, the media gateway 1370 may convert from PCM signals to Real-Time Transport Protocol (RTP) signals, as an illustrative, non-limiting example. The media gateway 1370 may convert data between packet switched networks (e.g., a Voice Over Internet Protocol (VoIP) network, an IP Multimedia Subsystem (IMS), a fourth generation (4G) wireless network, such as LTE, WiMax, and UMB, etc.), circuit switched networks (e.g., a PSTN), and hybrid networks (e.g., a second generation (2G) wireless network, such as GSM, GPRS, and EDGE, a third generation (3G) wireless network, such as WCDMA, EV-DO, and HSPA, etc.).

Additionally, the media gateway 1370 may include a transcoder, such as the transcoder 610, and may be configured to transcode data when codecs are incompatible. For example, the media gateway 1370 may transcode between an Adaptive Multi-Rate (AMR) codec and a G.711 codec, as an illustrative, non-limiting example. The media gateway 1370 may include a router and a plurality of physical interfaces. In some implementations, the media gateway 1370 may also include a controller (not shown). In a particular implementation, the media gateway controller may be external to the media gateway 1370, external to the base station 1300, or both. The media gateway controller may control and coordinate operations of multiple media gateways. The media gateway 1370 may receive control signals from the media gateway controller and may function to bridge between different transmission technologies and may add service to end-user capabilities and connections.

The base station 1300 may include a demodulator 1362 that is coupled to the transceivers 1352, 1354, the receiver data processor 1364, and the processor 1306, and the receiver data processor 1364 may be coupled to the processor 1306. The demodulator 1362 may be configured to demodulate modulated signals received from the transceivers 1352, 1354 and to provide demodulated data to the receiver data processor 1364. The receiver data processor 1364 may be configured to extract a message or audio data from the demodulated data and send the message or the audio data to the processor 1306.

The base station 1300 may include a transmission data processor 1382 and a transmission multiple input-multiple output (MIMO) processor 1384. The transmission data processor 1382 may be coupled to the processor 1306 and the transmission MIMO processor 1384. The transmission MIMO processor 1384 may be coupled to the transceivers 1352, 1354 and the processor 1306. In some implementations, the transmission MIMO processor 1384 may be coupled to the media gateway 1370. The transmission data processor 1382 may be configured to receive the messages or the audio data from the processor 1306 and to code the messages or the audio data based on a coding scheme, such as CDMA or orthogonal frequency-division multiplexing (OFDM), as an illustrative, non-limiting examples. The transmission data processor 1382 may provide the coded data to the transmission MIMO processor 1384.

The coded data may be multiplexed with other data, such as pilot data, using CDMA or OFDM techniques to generate multiplexed data. The multiplexed data may then be modulated (i.e., symbol mapped) by the transmission data processor 1382 based on a particular modulation scheme (e.g., Binary phase-shift keying ("BPSK"), Quadrature phase-shift keying ("QSPK"), M-ary phase-shift keying ("M-PSK"), M-ary Quadrature amplitude modulation ("M-QAM"), etc.) to generate modulation symbols. In a particular implementation, the coded data and other data may be modulated using different modulation schemes. The data rate, coding, and modulation for each data stream may be determined by instructions executed by processor 1306.

The transmission MIMO processor 1384 may be configured to receive the modulation symbols from the transmission data processor 1382 and may further process the modulation symbols and may perform beamforming on the data. For example, the transmission MIMO processor 1384 may apply beamforming weights to the modulation symbols.

During operation, the second antenna 1344 of the base station 1300 may receive a data stream 1314. The second transceiver 1354 may receive the data stream 1314 from the second antenna 1344 and may provide the data stream 1314 to the demodulator 1362. The demodulator 1362 may demodulate modulated signals of the data stream 1314 and provide demodulated data to the receiver data processor 1364. The receiver data processor 1364 may extract audio data from the demodulated data and provide the extracted audio data to the processor 1306.

The processor 1306 may provide the audio data to the transcoder 1310 for transcoding. The decoder 1338 of the transcoder 1310 may decode the audio data from a first format into decoded audio data and the encoder 1336 may encode the decoded audio data into a second format. In some implementations, the encoder 1336 may encode the audio data using a higher data rate (e.g., up-convert) or a lower data rate (e.g., down-convert) than received from the wireless device. In other implementations the audio data may not be transcoded. Although transcoding (e.g., decoding and encoding) is illustrated as being performed by a transcoder 1310, the transcoding operations (e.g., decoding and encoding) may be performed by multiple components of the base station 1300. For example, decoding may be performed by the receiver data processor 1364 and encoding may be performed by the transmission data processor 1382. In other implementations, the processor 1306 may provide the audio data to the media gateway 1370 for conversion to another transmission protocol, coding scheme, or both. The media gateway 1370 may provide the converted data to another base station or core network via the network connection 1360.

The encoder 1336 may determine the final shift value 116 indicative of an amount of temporal mismatch between the first audio signal 130 and the second audio signal 132. The encoder 1336 may perform a time-shift operation on the second audio signal 132 (e.g., the target channel) to generate an adjusted target channel. The encoder 1336 may perform a first transform operation on the first audio signal 130 (e.g., the reference channel) to generate a frequency-domain reference channel and may perform a second transform operation on the adjusted target channel to generate a frequency-domain adjusted target channel. The encoder 1336 may estimate one or more stereo cues based on the frequency-domain reference channel and the frequency-domain adjusted target channel. Encoded audio data generated at the encoder 1336 may be provided to the transmission data processor 1382 or the network connection 1360 via the processor 1306.

The transcoded audio data from the transcoder 1310 may be provided to the transmission data processor 1382 for coding according to a modulation scheme, such as OFDM, to generate the modulation symbols. The transmission data processor 1382 may provide the modulation symbols to the transmission MIMO processor 1384 for further processing and beamforming. The transmission MIMO processor 1384 may apply beamforming weights and may provide the modulation symbols to one or more antennas of the array of antennas, such as the first antenna 1342 via the first transceiver 1352. Thus, the base station 1300 may provide a transcoded data stream 1316, that corresponds to the data stream 1314 received from the wireless device, to another wireless device. The transcoded data stream 1316 may have a different encoding format, data rate, or both, than the data stream 1314. In other implementations, the transcoded data stream 1316 may be provided to the network connection 1360 for transmission to another base station or a core network.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed implementations is provided to enable a person skilled in the art to make or use the disclosed implementations. Various modifications to these implementations will be readily apparent to those skilled in the art, and the principles defined herein may be applied to other implementations without departing from the scope of the disclosure. Thus, the present disclosure is not intended to be limited to the implementations shown herein but is to be accorded the widest scope possible consistent with the principles and novel features as defined by the following claims.

What is claimed is:

1. A device comprising:

an encoder configured to:

determine a mismatch value indicative of an amount of temporal mismatch between a reference channel and a target channel;

perform a first temporal-shift operation on the target channel at least based on the mismatch value to generate an adjusted target channel;

perform a first transform operation on the reference channel to generate a frequency-domain reference channel;

perform a second transform operation on the adjusted target channel to generate a frequency-domain adjusted target channel;

perform, in a transform domain, a second temporal-shift operation on the frequency-domain adjusted target channel based on a second mismatch value to generate a modified frequency-domain adjusted target channel; and estimate one or more stereo cues based on the frequency-domain reference channel and the modified frequency-domain adjusted target channel; and a transmitter configured to transmit the one or more stereo cues.

2. The device of claim 1, wherein the encoder is further configured to determine the second mismatch value, the second mismatch value indicating a temporal shift between the reference channel and the adjusted target channel in the transform-domain.

3. The device of claim 1, wherein the encoder is further configured to generate a time-domain mid-band channel based on the reference channel and the adjusted target channel.

4. The device of claim 3, wherein the encoder is further configured to encode the time-domain mid-band channel to generate a mid-band bit-stream, and wherein the transmitter is further configured to transmit the mid-band bit-stream to a receiver.

5. The device of claim 3, wherein the encoder is further configured to:

generate a side-band channel based on the frequency-domain reference channel, the frequency-domain adjusted target channel, and the one or more stereo cues;

perform a third transform operation on the time-domain mid-band channel to generate a frequency-domain mid-band channel; and generate a side-band bit-stream based on the side-band channel, the frequency-domain mid-band channel, and the one or more stereo cues, wherein the transmitter is further configured to transmit the side-band bit-stream to a receiver.

6. The device of claim 1, wherein the encoder is further configured to generate a frequency-domain mid-band channel based on the frequency-domain reference channel and the frequency-domain adjusted target channel.

7. The device of claim 6, wherein the encoder is further configured to encode the frequency-domain mid-band channel to generate a mid-band bit-stream, and wherein the transmitter is further configured to transmit the mid-band bit-stream to a receiver.

8. The device of claim 7, wherein the encoder is further configured to:

generate a side-band channel based on the frequency-domain reference channel, the frequency-domain adjusted target channel, and the one or more stereo cues; and generate a side-band bit-stream based on the side-band channel, the mid-band bit-stream, and the one or more stereo cues, wherein the transmitter is further configured to transmit the side-band bit-stream to the receiver.

9. The device of claim 6, wherein the encoder is further configured to:

generate a side-band channel based on the frequency-domain reference channel, the frequency-domain adjusted target channel, and the one or more stereo cues; and generate a side-band bit-stream based on the side-band channel, the frequency-domain mid-band channel, and the one or more stereo cues, wherein the transmitter is further configured to transmit the side-band bit-stream to a receiver.

10. The device of claim 1, wherein the encoder is further configured to:

generate a first down-sampled channel by down-sampling the reference channel;

generate a second down-sampled channel by down-sampling the target channel; and determine comparison values based on the first down-sampled channel and a plurality of mismatch values applied to the second down-sampled channel, wherein the mismatch value is based on the comparison values.

11. The device of claim 1, wherein the mismatch value corresponds to an amount of time delay between receipt, via a first microphone, of a first frame of the reference channel and receipt, via a second microphone, of a second frame of the target channel.

12. The device of claim 1, wherein the stereo cues include one or more parameters that enable rendering of spatial properties associated with left channels and right channels.

13. The device of claim 1, wherein the stereo cues include one or more inter-channel intensity parameters, inter-channel intensity difference (IID) parameters, inter-channel phase parameters, inter-channel phase differences (IPD) parameters, non-causal shift parameters, spectral tilt parameters, inter-channel voicing parameters, inter-channel pitch parameters, inter-channel gain parameters, or a combination thereof.

14. The device of claim 1, wherein the encoder is integrated into a mobile device.

15. The device of claim 1, wherein the encoder is integrated into a base station.

16. A method of communication comprising:

determining, at a first device, a mismatch value indicative of an amount of temporal mismatch between a reference channel and a target channel;

performing a first temporal-shift operation on the target channel at least based on the mismatch value to generate an adjusted target channel;

performing a first transform operation on the reference channel to generate a frequency-domain reference channel;

performing a second transform operation on the adjusted target channel to generate a frequency-domain adjusted target channel;

performing, in a transform domain, a second temporal-shift operation on the frequency-domain adjusted target channel based on a second mismatch value to generate a modified frequency-domain adjusted target channel;

estimating one or more stereo cues based on the frequency-domain reference channel and the modified frequency-domain adjusted target channel; and transmitting the one or more stereo cues.

17. The method of claim 16, further comprising determining the second mismatch value, the second mismatch value indicating a temporal shift between the reference channel and the adjusted target channel in the transform-domain.

18. The method of claim 16, further comprising generating a time-domain mid-band channel based on the reference channel and the adjusted target channel.

19. The method of claim 18, further comprising:

encoding the time-domain mid-band channel to generate a mid-band bit-stream; and sending the mid-band bit-stream to a second device.

20. The method of claim 18, further comprising:

generating a side-band channel based on the frequency-domain reference channel, the frequency-domain adjusted target channel, and the one or more stereo cues;

performing a third transform operation on the time-domain mid-band channel to generate a frequency-domain mid-band channel;

generating a side-band bit-stream based on the side-band channel, the frequency-domain mid-band channel, and the one or more stereo cues; and sending the side-band bit-stream to a second device.

21. The method of claim 16, further comprising generating a frequency-domain mid-band channel based on the frequency-domain reference channel and the frequency-domain adjusted target channel.

22. The method of claim 21, further comprising:

encoding the frequency-domain mid-band channel to generate a mid-band bit-stream; and sending the mid-band bit-stream to a second device.

23. The method of claim 22, further comprising:

generating a side-band channel based on the frequency-domain reference channel, the frequency-domain adjusted target channel, and the one or more stereo cues;

generating a side-band bit-stream based on the side-band channel, the mid-band bit-stream, and the one or more stereo cues; and sending the side-band bit-stream to the second device.

24. The method of claim 21, further comprising:

generating a side-band channel based on the frequency-domain reference channel, the frequency-domain adjusted target channel, and the one or more stereo cues;

generating a side-band bit-stream based on the side-band channel, the frequency-domain mid-band channel, and the one or more stereo cues; and sending the side-band bit-stream to a second device.

25. The method of claim 16, further comprising:

generating a first down-sampled channel by down-sampling the reference channel;

generating a second down-sampled channel by down-sampling the target channel; and determining comparison values based on the first down-sampled channel and a plurality of mismatch values applied to the second down-sampled channel, wherein the mismatch value is based on the comparison values.

26. The method of claim 16, wherein the first device comprises a mobile device.

27. The method of claim 16, wherein the first device comprises a base station.

28. A non-transitory computer-readable storage device storing instructions that, when executed by a processor, cause the processor to perform operations comprising:

determining, at a first device, a mismatch value indicative of an amount of temporal mismatch between a reference channel and a target channel;

performing a first temporal-shift operation on the target channel based on the mismatch value to generate an adjusted target channel;

performing a first transform operation on the reference channel to generate a frequency-domain reference channel;

performing a second transform operation on the adjusted target channel to generate a frequency-domain adjusted target channel;

performing, in a transform, domain, a second temporal-shift operation on the frequency-domain adjusted target channel based on a second mismatch value to generate a modified frequency-domain adjusted target channel;

estimating one or more stereo cues based on the frequency-domain reference channel and the modified frequency-domain adjusted target channel; and initiating transmission of the one or more stereo cues.

29. The non-transitory computer-readable storage device of claim 28, further comprising determining the second mismatch value, the second mismatch value indicating a temporal shift between the reference channel and the adjusted target channel in the transform-domain.

30. The non-transitory computer-readable storage device of claim 28, wherein the operations further comprise generating a time-domain mid-band channel based on the reference channel and the adjusted target channel.

31. The non-transitory computer-readable storage device of claim 30, wherein the operations further comprise:

encoding the time-domain mid-band channel to generate a mid-band bit-stream; and initiating transmission of the mid-band bit-stream to a second device.

32. The non-transitory computer-readable storage device of claim 30, wherein the operations further comprise:

generating a side-band channel based on the frequency-domain reference channel, the frequency-domain adjusted target channel, and the one or more stereo cues;

performing a third transform operation on the time-domain mid-band channel to generate a frequency-domain mid-band channel;

generating a side-band bit-stream based on the side-band channel, the frequency-domain mid-band channel, and the one or more stereo cues; and initiating transmission of the side-band bit-stream to a second device.

33. The non-transitory computer-readable storage device of claim 28, wherein the operations further comprise generating a frequency-domain mid-band channel based on the frequency-domain reference channel and the frequency-domain adjusted target channel.

34. The non-transitory computer-readable storage device of claim 33, wherein the operations further comprise:

encoding the frequency-domain mid-band channel to generate a mid-band bit-stream; and initiating transmission of the mid-band bit-stream to a second device.

35. The non-transitory computer-readable storage device of claim 34, wherein the operations further comprise:

generating a side-band channel based on the frequency-domain reference channel, the frequency-domain adjusted target channel, and the one or more stereo cues;

generating a side-band bit-stream based on the side-band channel, the mid-band bit-stream, and the one or more stereo cues; and initiating transmission of the side-band bit-stream to the second device.

36. The non-transitory computer-readable storage device of claim 33, wherein the operations further comprise:

generating a side-band channel based on the frequency-domain reference channel, the frequency-domain adjusted target channel, and the one or more stereo cues;

generating a side-band bit-stream based on the side-band channel, the frequency-domain mid-band channel, and the one or more stereo cues; and initiating transmission of the side-band bit-stream to a second device.

37. An apparatus comprising:

means for determining a mismatch value indicative of an amount of temporal mismatch between a reference channel and a target channel;

means for performing a first temporal-shift operation on the target channel based on the mismatch value to generate an adjusted target channel;

means for performing a first transform operation on the reference channel to generate a frequency-domain reference channel;

means for performing a second transform operation on the adjusted target channel to generate a frequency-domain adjusted target channel;

means for performing, in a transform domain, a second temporal-shift operation on the frequency-domain adjusted target channel based on a second mismatch value to generate a modified frequency-domain adjusted target channel;

means for estimating one or more stereo cues based on the frequency-domain reference channel and the modified frequency-domain adjusted target channel; and means for sending the one or more stereo cues.

38. The apparatus of claim 37, wherein the means for determining the mismatch value, the means for performing the first temporal-shift operation, the means for performing the first transform operation, the means for performing the second transform operation, the means for performing the second temporal-shift operation, the means for estimating, and the means for sending are integrated into a mobile device.

39. The apparatus of claim 37, wherein the means for determining the mismatch value, the means for performing the first temporal time-shift operation, the means for performing the first transform operation, the means for performing the second transform operation, the means for performing the second temporal-shift operation, the means for estimating, and the means for sending are integrated into a base station.

40. The device of claim 1, wherein the second temporal-shift operation includes a non-causal shift.

41. The method of claim 16, wherein the second temporal-shift operation includes a non-causal shift.

42. The non-transitory computer-readable storage device of claim 28, wherein the second temporal-shift operation includes a non-causal shift.

43. The apparatus of claim 37, wherein the second temporal-shift operation includes a non-causal shift.

* * * * *